US008865384B2

(12) United States Patent
Yamada et al.

(10) Patent No.: US 8,865,384 B2
(45) Date of Patent: Oct. 21, 2014

(54) ELECTROPHOTOGRAPHIC TONER, DEVELOPER, AND IMAGE FORMING APPARATUS

(71) Applicants: Masahide Yamada, Shizuoka (JP); Shinya Nakayama, Shizuoka (JP); Atsushi Yamamoto, Shizuoka (JP); Hideyuki Santo, Shizuoka (JP); Shingo Sakashita, Shizuoka (JP); Yukiko Nakajima, Kanagawa (JP); Suzuka Amemori, Shizuoka (JP); Akiyoshi Sabu, Shizuoka (JP)

(72) Inventors: Masahide Yamada, Shizuoka (JP); Shinya Nakayama, Shizuoka (JP); Atsushi Yamamoto, Shizuoka (JP); Hideyuki Santo, Shizuoka (JP); Shingo Sakashita, Shizuoka (JP); Yukiko Nakajima, Kanagawa (JP); Suzuka Amemori, Shizuoka (JP); Akiyoshi Sabu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/790,541

(22) Filed: Mar. 8, 2013

(65) Prior Publication Data

US 2013/0252158 A1 Sep. 26, 2013

(30) Foreign Application Priority Data

Mar. 21, 2012 (JP) ..... 2012-063847

(51) Int. Cl.
*G03G 9/08* (2006.01)
*G03G 9/087* (2006.01)
*G03G 9/097* (2006.01)

(52) U.S. Cl.
CPC ..... *G03G 9/08764* (2013.01); *G03G 9/0804* (2013.01); *G03G 9/08791* (2013.01); *G03G 9/08795* (2013.01); *G03G 9/08797* (2013.01); *G03G 9/09708* (2013.01); *G03G 9/09716* (2013.01)
USPC ..... 430/108.6; 430/108.2; 430/108.7; 430/109.1; 430/109.4

(58) Field of Classification Search
CPC ..... G03G 9/08764; G03G 9/08791
USPC ..... 430/108.2, 109.4, 108.6, 108.7, 109.1
See application file for complete search history.

(56) References Cited

U.S. PATENT DOCUMENTS

| | | | | |
|---|---|---|---|---|
| 8,084,180 | B2 * | 12/2011 | Zhou et al. | 430/110.2 |
| 2001/0046636 | A1 | 11/2001 | Daimon et al. | |
| 2008/0107986 | A1 * | 5/2008 | Michel et al. | 430/84 |
| 2012/0282000 | A1 | 11/2012 | Nakayama et al. | |
| 2013/0244011 | A1 * | 9/2013 | Sabu et al. | 430/109.5 |
| 2013/0244153 | A1 * | 9/2013 | Nakayama et al. | 430/108.22 |

FOREIGN PATENT DOCUMENTS

| | | | |
|---|---|---|---|
| JP | 63-038955 | | 2/1988 |
| JP | 04-024702 | | 4/1992 |
| JP | 04-024703 | | 4/1992 |
| JP | 3360527 | | 10/2002 |
| JP | 3910338 | | 2/2007 |
| JP | 3949526 | | 4/2007 |
| JP | 2007-272205 | | 10/2007 |
| JP | 2008-225422 | | 9/2008 |
| JP | 2008-233406 | | 10/2008 |
| JP | 2010-077419 | | 4/2010 |
| JP | 2010077419 | A * | 4/2010 |
| JP | 4513627 | | 5/2010 |
| JP | 4929411 | | 2/2012 |
| WO | WO 2012/011546 | A1 | 1/2012 |

OTHER PUBLICATIONS

Borsenberger, Paul M. et al. Organic Photoreceptors for Imaging Systems New York: Marcel-Dekker, Inc. (1993) pp. 6-17.*
English language machine translation of JP 2010-77419 (Apr. 2010).*
U.S. Appl. No. 13/793,561, filed Mar. 4, 2013, Nakayama, et al.

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

An electrophotographic toner, including: a binder resin; a colorant; and an organically-modified layered inorganic mineral, wherein the binder resin contains 50% by mass or more of a crystalline resin relative to the binder resin, and the crystalline resin contains a resin having a sulfonic acid group, and wherein an amount of the sulfonic acid group is 0.1% by mass to 2.0% by mass relative to the resin having the sulfonic acid group.

9 Claims, 3 Drawing Sheets

ELECTROPHOTOGRAPHIC TONER, DEVELOPER, AND IMAGE FORMING APPARATUS

BACKGROUND OF THE INVENTION

1. Field of the Invention

The present invention relates to an electrophotographic toner, a developer, and an image forming apparatus.

2. Description of the Related Art

Conventionally, in an image forming apparatus of an electrophotographic type and the like, a latent image that is electrically or magnetically formed is visualized with the help of electrophotographic toner (which may be simply referred to as "toner," hereinafter). For example, according to an electrophotographic method, an electrostatic charge image (latent image) is formed on a photoconductor, and the latent image is then developed with the toner. In this manner, a toner image is formed. The toner image is usually transferred onto a transfer material such as paper, and is then fixed on the transfer material. In a fixation process of fixing the toner image on the transfer paper, heat fixation methods, such as a heating roller fixation method and a heating belt fixation method, have been widely used because the heat fixation methods are good in energy efficiency.

In recent years, the market's needs for high-speed, energy-saving image forming apparatus have been further growing. What is desired is a toner that is excellent in low-temperature fixation performance and able to provide high-quality images. To achieve the low-temperature fixation performance of the toner, a softening temperature of binder resin of the toner needs to be made lower. However, if the softening temperature of the binder resin is low, a so-called offset (also referred to as "hot offset," hereinafter) can easily occur as part of the toner image adheres to a surface of a fixation member during the fixation process, and is transferred onto copy paper as a result. Moreover, the heat-resistant storage stability of the toner decreases, and so-called blocking can occur as particles of the toner are fused together particularly in a high-temperature environment. Other problems also arise: In a developing unit, the toner is fused to the inside of the developing unit or a carrier, resulting in contamination; and the filming of the toner can easily occur on the surface of the photoconductor.

As for a technique for solving the above problems, the use of crystalline resin as the binder resin of the toner is known. That is, the crystalline resin softens rapidly at a melting point of the resin, and is able to bring the softening temperature of the toner down to around the melting point while ensuring the heat-resistant storage stability below the melting point. Therefore, if the crystalline resin is used in the toner, both the low-temperature fixation performance and the heat-resistant storage stability can be achieved.

For example, as a toner that uses the crystalline resin, a toner that uses, as binder resin, a crystalline resin whose crystalline polyester is extended with diisocyanate has been disclosed (see Japanese Patent Application Publication (JP-B) Nos. 04-024702 and 04-024703). Although the toner is excellent in low-temperature fixation performance, the problem is that the hot-offset resistance thereof is insufficient, and the quality thereof falls short of a level required in recent years.

Then, a toner using a crystalline resin that contains a sulfonic acid group and has a crosslinked structure by unsaturated bond has been proposed (see Japanese Patent (JP-B) No. 3910338). With the toner, there is an improvement in hot-offset resistance compared with conventional ones. Moreover, the technology of the following resin particles is disclosed (see Japanese Patent Application Laid-Open No. 2010-077419): the resin particles are excellent in low-temperature fixation performance and heat-resistant storage stability, with the ratio of softening temperature and heat-of-fusion peak temperature, and the viscoelastic properties defined.

Although the toner that uses the above crystalline resin as main component of the binder resin is excellent in impact resistance because of the properties of the crystalline resin, the toner is weak in indentation hardness such as Vickers hardness. Therefore, stirring stress in the development unit is likely to cause problems, such as contamination of the carrier or the inside of the unit, the filming on the photoconductor, and deterioration of electrification characteristics and liquidity caused by external additive buried. Moreover, it takes time for the toner that has melted on a fixation medium at the time of heat fixing to be crystallized again. Therefore, the hardness of the surface of the image cannot quickly recover. Thus, the problem is that, because of paper discharge rollers or the like during a paper discharge process after fixation, changes in gloss and scratches could occur on the surface of the image due to rollers' traces. Another problem is that, since the hardness is insufficient even after the hardness of the surface of the image has been recovered by the recrystallization of the toner, the image is vulnerable to scratching and rubbing.

Meanwhile, a technique for improving the stress resistance of the toner is disclosed (see JP-B No. 3360527): According to the technique, the durometer hardness of the crystalline resin is defined, and inorganic fine particles are contained in the toner.

However, the technique cannot be used to repair scratches that are caused by rollers' traces immediately after the fixation; the hardness of the image after the recrystallization is insufficient. Another problem is that the low-temperature fixation performance is significantly inhibited by inorganic fine particles, and the advantage of the fixation to the crystalline resin cannot be fully utilized.

A large number of techniques for using both crystalline resin and amorphous resin, instead of using crystalline resin as a main component of the binder resin, are disclosed (for example, see JP-B Nos. 3949526 and 4513627). The above toners can compensate for the disadvantage of the hardness of the crystalline resin with the amorphous resin. However, the problem is that the crystalline resin that is effective in terms of low-temperature fixation performance cannot be fully utilized.

SUMMARY OF THE INVENTION

The object of the present invention is to solve the above problems associated with the conventional techniques, and to achieve the following objectives. That is, an objective of the present invention is to solve, in a toner that substantially uses, as a main component thereof, a crystalline resin that is greater than or equal to 50% by mass of a binder resin, the following problems unique to the toner that uses the crystalline resin, without having adverse effects on the low-temperature fixation performance: the lack of stress resistance, the occurrence of image-transport scratches that occur during the recrystallization immediately after heat fixing, and the lack of the hardness of an output image. Another objective of the present invention is to provide an electrophotographic toner that can achieve high levels of both low-temperature fixation performance and heat-resistant storage stability.

The means for achieving the above objectives are as follows:

An electrophotographic toner of the present invention includes:

a binder resin;

a colorant; and an organically-modified layered inorganic mineral, wherein the binder resin contains 50% by mass or more of a crystalline resin relative to the binder resin, and the crystalline resin contains a resin having a sulfonic acid group, and wherein an amount of the sulfonic acid group is 0.1% by mass to 2.0% by mass relative to the resin having the sulfonic acid group.

According to the present invention, it is possible to solve the problems associated with the conventional ones, and to achieve the above objectives. It is therefore possible to solve, in a toner that substantially uses, as a main component thereof, a crystalline resin that is greater than or equal to 50% by mass of a binder resin, the following problems unique to the toner that uses the crystalline resin, without having adverse effects on the low-temperature fixation performance: the lack of stress resistance, the occurrence of image-transport scratches that occur during the recrystallization immediately after heat fixing, and the lack of the hardness of an output image. It is also possible to provide an electrophotographic toner that can achieve high levels of both low-temperature fixation performance and heat-resistant storage stability.

Figure 1:
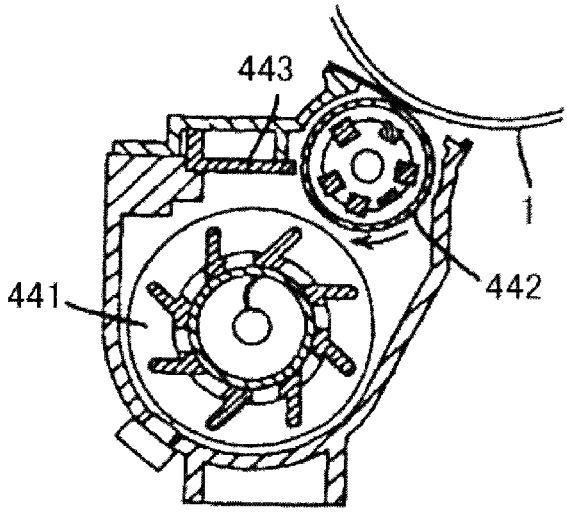
FIG. 1 is a schematic diagram showing one example of two-component developing unit in an image forming apparatus of the present invention.

DETAILED DESCRIPTION OF THE INVENTION (Electrophotographic Toner)

An electrophotographic toner of the present invention (which may be simply referred to as "toner," hereinafter) includes at least a binder resin, a colorant, and an organically-modified layered inorganic mineral. The electrophotographic toner may further contain other components when required.

The present inventors intensively studied ways to achieve the above objectives, and found that, by including an organically-modified layered inorganic mineral, in which at least some of ions between layers of the layered inorganic mineral have been modified by organic ions, in a toner, and by making the binder resin contain a crystalline resin having a sulfonic acid group, it is possible to add stress resistance of the same level as conventional technology. Moreover, the present inventors found that, unlike the conventional technology, it is possible to avoid the occurrence of image-transport scratches that could occur during the recrystallization immediately after heat fixing, and the lack of the hardness of an output image. In this manner, the present inventors came up with the present invention.

The layered inorganic mineral is most effective at a time when the layered inorganic mineral is disposed in such a way as to be finely dispersed in the vicinity of a surface layer of a toner. According to the present invention, it is known that the organically-modified layered inorganic mineral has been finely dispersed in the toner in a stable manner, and has been disposed evenly in the vicinity of the surface layer of the toner with no space. Therefore, the structural viscosity of the binder resin in the vicinity of the surface layer of the toner is efficiently increased, and an image is sufficiently protected even in the situation immediately after fixation, or in the situation where the image is low in resin hardness. Moreover, the layered inorganic mineral can exert effects in an efficient manner even when the amount of the layered inorganic mineral added is small. Therefore, inhibition of the fixation performance is considered almost nonexistent.

<Binder Resin>

The binder resin is not specifically restricted as long as the binder resin contains 50% by mass or more of the crystalline resin, i.e. the binder resin is substantially made mainly from the crystalline resin. The binder resin can be appropriately selected depending on the intended purpose. For example, the binder resin may further contain an amorphous resin.

The crystalline resin contains a resin that has a sulfonic acid group.

The amount of the crystalline resin contained in the binder resin is not specifically restricted as long as the amount is greater than or equal to 50% by mass. The amount can be appropriately selected depending on the intended purpose. However, in order for the crystalline resin to achieve excellent, maximum levels of both low-temperature fixation performance and heat-resistant storage stability, the amount is preferably 65% by mass or more, more preferably 80% by mass or more, particularly preferably 95% by mass or more. All, or 100% by mass, of the binder resin may be crystalline resin. If the amount contained is less than 50% by mass, the heat steepness of the binder resin cannot be expressed on the viscoelastic properties of the toner, making it difficult to achieve both the low-temperature fixation performance and the heat-resistant storage stability.

<<Resin Having a Sulfonic Acid Group>>

The crystalline resin contains a resin having a sulfonic acid group. The resin having a sulfonic acid group is not specifically restricted. The resin can be appropriately selected depending on the intended purpose.

Since the crystalline resin contains a resin having a sulfonic acid group, it is possible to finely disperse the organically-modified layered inorganic mineral in the binding resin.

A method of producing the resin having a sulfonic acid group is not particularly restricted. The method can be appropriately selected depending on the intended purpose. For example, the resin can be produced by copolymerization of a monomer having a sulfonic acid group and another monomer.

If the resin having a sulfonic acid group is a polyester resin having a sulfonic acid group, the resin can be produced for example by polymerization of a polycarboxylic acid having a sulfonic acid group and a polyol. Moreover, the resin can be produced by polymerization of a polyol having a sulfonic acid group and a polycarboxylic acid.

The polycarboxylic acid having a sulfonic acid group is not specifically restricted. The polycarboxylic acid can be appropriately selected depending on the intended purpose. For example, a polycarboxylic acid having a sulfonic acid group, which is shown as an example in explaining the polyester resin described later, may be used.

The polyol having a sulfonic acid group is not specifically restricted. The polyol can be appropriately selected depending on the intended purpose. For example, a polyol having a sulfonic acid group, which is shown as an example in explaining the polyester resin described later, may be used.

The amount of the sulfonic acid group is not specifically restricted. The amount can be appropriately selected depending on the intended purpose. However, it is preferred that the amount be 0.1% by mass to 2.0% by mass relative to the resin having the sulfonic acid group. If the amount is less than 0.1% by mass, the dispersion effect of the organically-modified layered inorganic mineral may not be obtained. If the amount is greater than 2.0% by mass, the crystallinity of the crystalline resin may be inhibited, and the melting point and the like may decrease, possibly resulting in a decrease in toner storage stability.

The "crystalline resin" of the present invention is a resin whose ratio (Softening temperature/Maximum peak temperature of heat of fusion) of the softening temperature, which is measured by a high load-type flow tester, and a maximum peak temperature of the heat of fusion, which is measured by a differential scanning calorimeter (DSC), is 0.80 to 1.55. The "crystalline resin" has such properties as to be steeply softened by heat.

The "amorphous resin" is a resin whose ratio (Softening temperature/Maximum peak temperature of heat of fusion) of the softening temperature and the maximum peak temperature of the heat of fusion is greater than 1.55. The "amorphous resin" has such properties as to be gently softened by heat.

Incidentally, the presence of the crystalline resin in the toner can be confirmed by applying the above method to a resin extracted from the toner.

Incidentally, the softening temperatures of the binder resin and toner can be measured by a high load-type flow tester (e.g. CFT-500D (manufactured by Shimadzu Corporation)). The sample is 1 g of the binder resin or toner, which is heated at a temperature-rise rate of 6° C. per minute. During the operation, a plunger is used to give a load of 1.96 MPa. The sample is extruded from a nozzle with a diameter of 1 mm and a length of 1 mm. The amount of plunger descent of the flow tester is plotted relative to temperatures, and a temperature at which half of the sample has been leaked is regarded as a softening temperature.

The heat-of-fusion maximum peak temperatures of the binder resin and toner can be measured by a differential scanning calorimeter (DSC) (e.g. TA-60WS and DSC-60 (manufactured by Shimadzu Corporation)). A sample that is used for measurement of a heat-of-fusion maximum peak temperature is melted at 130° C. as pretreatment. Then, the temperature is decreased at a rate of 1.0° C. per minute from 130° C. to 70° C. Then, the temperature is decreased at a rate of 0.5° C. per minute from 70° C. to 10° C. The DSC is then used once to measure endothermic/exothermic changes as the temperature is increased at a temperature-rise rate of 20° C. per minute, and a graph of "endothermic/exothermic amount" and "temperature" is created. An endothermic peak temperature that is measured at that time at 20° C. to 100° C. is represented by "Ta*." If there are a plurality of endothermic peaks, the temperature of a peak with the largest endothermic amount is regarded as Ta*. Then, the sample is stored for six hours at (Ta*−10)° C., and then is stored for six hours at (Ta*−15)° C. Then, the sample is cooled by the DSC down to 0° C. at a temperature-drop rate of 10° C. per minute. Then, the temperature is increased at a temperature-rise rate of 20° C. per minute, and endothermic/exothermic changes are measured, and a similar graph is created. A temperature corresponding to a maximum peak of endothermic/exothermic amount is regarded as a maximum peak temperature of the heat of fusion.

<<Crystalline Resin>>

The crystalline resin is not specifically restricted as long as the resin has crystallinity. The crystalline resin can be appropriately selected depending on the intended purpose. For example, the crystalline resin may be polyester resin, polyurethane resin, polyurea resin, polyamide resin, polyether resin, vinyl resin, modified crystalline resin, or the like. One of the above substances may be used independently, or two or more of the above substances may be used in combination. Among the above substances, the polyester resin, the polyurethane resin, the polyurea resin, the polyamide resin, and the polyether resin are preferred. A resin having at least either a urethane skeleton or urea skeleton is preferred. Moreover, a linear polyester resin, or a composite resin containing the linear polyester resin, is more preferred.

In this case, as for the resin having at least either a urethane skeleton or urea skeleton, for example, the following resins are preferred among other things: the polyurethane resin, the polyurea resin, a urethane-modified polyester resin, and a urea-modified polyester resin.

As for the urethane-modified polyester resin, for example, the following resins are available among other things: a polyester resin having an isocyanate group at a terminal; a resin made by reacting with polyol; a polyester resin having a hydroxyl group at a terminal; and a resin made by reacting with polyisocyanate. The urea-modified polyester resin is a resin made by reacting a polyester resin having an isocyanate group at a terminal with amines.

In terms of being able to achieve both the low-temperature fixation performance and heat-resistant storage stability of the toner, the heat-of-fusion maximum peak temperature of the crystalline resin is preferably 45° C. to 70° C., more preferably 53° C. to 65° C., particularly preferably 58° C. to 62° C. If the maximum peak temperature is less than 45° C., the low-temperature fixation performance becomes better, but the heat-resistant storage stability becomes worse. If the maximum peak temperature is greater than 70° C., the heat-resistant storage stability becomes better, but the low-temperature fixation performance becomes worse.

The crystalline resin's ratio (Softening temperature/Maximum peak temperature of heat of fusion) of the softening temperature and the maximum peak temperature of the heat of fusion is 0.80 to 1.55. However, the ratio is preferably 0.85 to 1.25, more preferably 0.90 to 1.20, particularly preferably 0.90 to 1.19. The resin has such properties as to be steeply softened as the ratio becomes smaller. The properties are preferred in terms of being able to achieve both the low-temperature fixation performance and heat-resistant storage stability of the toner.

As for the viscoelastic properties of the crystalline resin, storage elastic modulus G' at (Heat-of-fusion maximum peak temperature)+20° C. is preferably less than or equal to $5.0\times10^{6}$ Pa·s, more preferably $1.0\times10^{1}$ Pa·s to $5.0\times10^{5}$ Pa·s, particularly preferably $1.0\times10^{1}$ Pa·s to $1.0\times10^{4}$ Pa·s. Moreover, loss elastic modulus G" at (Heat-of-fusion maximum peak temperature)+20° C. is preferably less than or equal to $5.0\times10^{6}$ Pa·s, more preferably $1.0\times10^{1}$ Pa·s to $5.0\times10^{5}$ Pa·s, particularly preferably $1.0\times10^{1}$ Pa·s to $1.0\times10^{4}$ Pa·s. As for the viscoelastic properties of the toner of the present invention, it is preferred that the values of G' and G" at (Heat-of-fusion maximum peak temperature)+20° C. be $1.0\times10^{3}$ Pa·s to $5.0\times10^{6}$ Pa·s, in terms of the fixation strength and the hot-offset resistance. Given that G' and G" rise as the colorant and the layered inorganic mineral are dispersed in the binder resin, it is preferred that the viscoelastic properties of the crystalline resin be within the above ranges.

The viscoelastic properties of the crystalline resin can be obtained by adjusting the ratio of crystalline and amorphous monomers that constitute the binder resin, or the molecular weight of the binder resin, or by performing any other operation. For example, as the ratio of crystalline monomers to the monomers that constitute the binder resin is increased, the value of G'(Ta+20) decreases.

The values of dynamic viscoelastic properties of the resin and toner (storage elastic modulus G' and loss elastic modulus G") can be measured by a dynamic viscoelasticity measuring device (e.g. ARES (manufactured by TA Instruments)). The measurement takes place under the condition that the frequency is 1 Hz. The sample is formed into pellets with a diameter of 8 mm and a thickness of 1 mm to 2 mm, and is fixed to a parallel plate with a diameter of 8 mm. Then, the temperature is kept at 40° C. At a frequency of 1 Hz (6.28 rad/s) and a strain amount of 0.1% (Strain amount control mode), the temperature is increased to 200° C. at a temperature-rise rate of 2.0° C. per minute before the measurement takes place.

In terms of fixability, the weight-average molecular weight (Mw) of the crystalline resin is preferably 2,000 to 100,000, more preferably 5,000 to 60,000, particularly preferably 8,000 to 30,000. If the weight-average molecular weight is less than 2,000, the hot-offset resistance tends to become worse. If the weight-average molecular weight is greater than 100,000, the low-temperature fixation performance tends to become worse.

According to the present invention, the weight-average molecular weight (Mw) of the binder resin can be measured by a gel permeation chromatography (GPC) measuring device (e.g., GPC-8220GPC (manufactured by TOSOH CORPORATION). As for a column that is used for the measurement, TSKgel SuperHZM-H 15 cm with an inside diameter of 3 μm (manufactured by TOSOH CORPORATION) is used. A resin that is to be measured is turned into a 0.15% by mass solution with tetrahydrofuran (THF) (containing a stabilizer, manufactured by Wako Pure Chemical Industries, Ltd.). The solution is then filtered with a 0.2 μm filter. The filtrate is used as a sample. Into the measuring device, 100 μL of the above THF sample solution is poured. In an environment at a temperature of 40° C., the measurement takes place at a flow rate of 0.35 mL per minute. As for the measurement of the molecular weight of the sample, the molecular weight is calculated from the relation between the logarithmic values and count numbers of calibration curves that are produced from several types of monodisperse polystyrene standard samples. For the standard polystyrene samples, the following are used: Std. No S-7300, S-210, S-390, S-875, S-1980, S-10.9, S-629, S-3.0, S-0.580 of ShowdexSTANDARD, manufactured by Showa Denko K.K.; and toluene. For the detector, a RI (Refractive Index) detector is used.

<<Polyester Resin>>

As for the polyester resin, for example, the following are available among other things: a polycondensation polyester resin that is synthesized from a polyol and a polycarboxylic acid; a lactone ring-opening polymerization product; and a polyhydroxy carboxylic acid. Among the above substances, the polycondensation polyester resin that is made from a diol and a dicarboxylic acid is preferred in terms of crystalline expression.

—Polyol—

As for the above polyol, for example, the following are available among other things: a diol; and a trivalent or higher-valent polyol (preferably between the trivalent and the octavalent).

The diol is not specifically restricted. The diol can be appropriately selected depending on the intended purpose. For example, the following are available among other things: aliphatic diols, such as linear aliphatic diols and branched aliphatic diols; alkylene ether glycols with a carbon number of 4 to 36; cycloaliphatic diols with a carbon number of 4 to 36; alkylene oxide (simply referred to as AO, hereinafter) of the cycloaliphatic diol; AO adducts of bisphenols; polylactonediol; polybutadienediol; a diol having a carboxyl group, a diol having a sulfonic acid group or a sulfamic acid group, and diols having other functional groups such as salts of the above substances. Among the above substances, an aliphatic diol with a carbon number of 2 to 36 is preferred; a linear aliphatic diol is even more preferred. One of the above substances may be used independently, or two or more of the above substances may be used in combination.

The amount of the linear aliphatic diol contained relative to the total amount of the diol is preferably greater than or equal to 80 mol %, more preferably greater than or equal to 90 mol %, particularly preferably between 90 mol % to 100 mol %. The amount contained is preferably greater than or equal to 80 mol %, because there is an improvement in the crystallinity of the resin, both the low-temperature fixation performance and the heat-resistant storage stability can be well achieved, and the hardness of the resin tends to improve.

The linear aliphatic diol is not specifically restricted. The linear aliphatic diol can be appropriately selected depending on the intended purpose. For example, the following are available among other things:

ethylene glycol, 1,3-propanediol, 1,4-butanediol, 1,5-pentanediol 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among the above substances, in terms of availability, ethylene glycol, 1,3-propanediol, 1,4-butanediol, 1,6-hexanediol, 1,9-nonanediol, and 1,10-decanediol are preferred.

The branched aliphatic diol with a carbon number of 2 to 36 is not specifically restricted. The branched aliphatic diol can be appropriately selected depending on the intended purpose. For example, the following are available among other things: 1,2-propylene glycol, butanediol, hexanediol, octanediol, decanediol, dodecanediol, tetra decanediol, neopentyl glycol and 2,2-diethyl-1,3-propanediol.

The alkylene ether glycol with a carbon number of 4 to 36 is not specifically restricted. The alkylene ether glycol can be appropriately selected depending on the intended purpose. For example, the following are available among other things: diethylene glycol, triethylene glycol, dipropylene glycol, polyethylene glycol, polypropylene glycol, and poly tetramethylene ether glycol.

The cycloaliphatic diol with a carbon number of 4 to 36 is not specifically restricted. The cycloaliphatic diol can be appropriately selected depending on the intended purpose. For example, the following are available among other things: 1,4-cyclohexanedimethanol, and hydrogenated bisphenol A.

The alkylene oxide of the cycloaliphatic diol is not specifically restricted. The alkylene oxide of the cycloaliphatic diol can be appropriately selected depending on the intended purpose. For example, the following are available among other things: adducts (The number of moles added is 1 to 30), such as ethylene oxide (simply referred to as EO, hereinafter), propylene oxide (simply referred to as PO, hereinafter), and butylene oxide (simply referred to as BO, hereinafter).

The bisphenols are not specifically restricted. The bisphenols can be appropriately selected depending on the intended purpose. For example, the following are available among other things: adducts of AO (such as EO, PO, or BO) (The number of moles added is 2 to 30), such as bisphenol A, bisphenol F, and bisphenol S.

The polylactonediol is not specifically restricted. The polylactonediol can be appropriately selected depending on the intended purpose. For example, the following is available among other things: poly-ε-caprolactonediol.

The diol having a carboxyl group is not specifically restricted. The diol can be appropriately selected depending on the intended purpose. For example, the following are available among other things: dialkylol alkanoic acids with a carbon number of 6 to 24, such as 2,2-dimethylol propionic acid (DMPA), 2,2-dimethylol butanoic acid, 2,2-dimethylol heptanoic acid, and 2,2-dimethylol octanoic acid.

The diol having a sulfonic acid group or a sulfamic acid group is not specifically restricted. The diol can be appropriately selected depending on the intended purpose. For example, the following are available among other things: sulfamic acid diol [N,N-bis(2-hydroxyalkyl) sulfamic acid (with an alkyl group's carbon number of 1 to 6) and AO adducts thereof (EO, PO, or the like as AO; the number of moles added for AO is 1 to 6), such as N,N-bis(2-hydroxyethyl) sulfamic acid and PO2-mole adducts of N,N-bis(2-hydroxyethyl) sulfamic acid; and bis(2-hydroxyethyl)phosphate.

A neutralization base of the above diols having the neutralization base is not specifically restricted. The neutralization base can be appropriately selected depending on the intended purpose. For example, the following are available among other things: tertiary amines with a carbon number of 3 to 30 (triethylamine and the like), alkali metals (sodium salts or the like).

Among the above substances, the following are preferred: an alkylene glycol with a carbon number of 2 to 12; a diol having a carboxyl group; an AO adduct of bisphenols; and the combination of the alkylene glycol, the diol and the AO adduct.

The trivalent or higher-valent polyol (preferably between the trivalent and the octavalent), which may be used when needed, is not specifically restricted. The polyol can be appropriately selected depending on the intended purpose. For example, the following are available among other things: trivalent or higher-valent polyhydric aliphatic alcohols (preferably between the trivalent and the octavalent) with a carbon number of 3 to 36, such as alkane polyols and intramolecular or intermolecular dehydration products thereof (e.g. glycerin, trimethylolethane, trimethylolpropane, pentaerythritol, sorbitol, sorbitan, polyglycerol, and the like), sugars, and derivatives thereof (e.g. sucrose, methylglucoside, and the like); AO adducts of trisphenols (trisphenol PA, and the like) (The number of moles added is 2 to 30); AO adducts of novolak resin (phenol novolac, cresol novolac, and the like) (The number of moles added is 2 to 30); acrylic polyols, such as a copolymer of hydroxyethyl(meth)acrylate and another vinyl monomer. Among the above substances, the trivalent or higher-valent polyhydric aliphatic alcohols (preferably between the trivalent and the octavalent), and the AO adducts of novolak resin are preferred; the AO adducts of novolak resin are even more preferred.

—Polycarboxylic Acid—

As for the polycarboxylic acid, for example, the following are available: dicarboxylic acid; and trivalent or higher-valent polycarboxylic acid (preferably between the trivalent and the hexavalent). The substances may include a sulfonic acid group.

The dicarboxylic acid is not specifically restricted. The dicarboxylic acid can be appropriately selected depending on the intended purpose. For example, the following are preferred: aliphatic dicarboxylic acids, such as linear aliphatic dicarboxylic acids and branched aliphatic dicarboxylic acids; and aromatic dicarboxylic acids. Among the above substances, the linear aliphatic dicarboxylic acids are more preferred.

The aliphatic dicarboxylic acid is not specifically restricted. The aliphatic dicarboxylic acid can be appropriately selected depending on the intended purpose. For example, the following are preferred among other things: alkanedicarboxylic acids with a carbon number of 4 to 36, such as succinic acid, adipic acid, sebacic acid, azelaic acid, dodecane dicarboxylic acid, octadecane dicarboxylic acid, and decyl succinic acid; alkenyl succinic acids, such as dodecenyl succinic acid, pentadecenyl succinic acid, and octadecenyl succinic acid; alkenedicarboxylic acids with a carbon number of 4 to 36, such as maleic acid, fumaric acid, and citraconic acid; and cycloaliphatic dicarboxylic acids with a carbon number of 6 to 40, such as dimer acid (dimerization linoleic acid).

The aromatic dicarboxylic acid is not specifically restricted. The aromatic dicarboxylic acid can be appropriately selected depending on the intended purpose. The following are preferred among other things: aromatic dicarboxylic acids with a carbon number of 8 to 36, such as phthalic acid, isophthalic acid, terephthalic acid, t-butyl isophthalic acid, 2,6-naphthalene dicarboxylic acid, and 4,4'-biphenyl dicarboxylic acid.

As for the trivalent or higher-valent polycarboxylic acid (preferably between the trivalent and the hexavalent) that may be used when necessary, for example, the following are available among other things: aromatic polycarboxylic acids with a carbon number of 9 to 20, such as trimellitic acid and pyromellitic acid.

Incidentally, as for the dicarboxylic acid or the trivalent or higher-valent polycarboxylic acid (preferably between the trivalent and the hexavalent), the following may also be used: acid anhydrides of the above substances, or lower alkyl esters with a carbon number of 1 to 4 (methyl ester, ethyl ester, isopropyl ester, and the like).

Among the above dicarboxylic acids, it is particularly preferred that the aliphatic dicarboxylic acid (which is preferably adipic acid, sebacic acid, dodecane dicarboxylic acid, terephthalic acid, isophthalic acid, or the like) be used independently. The following are similarly preferred: copolymers of the aliphatic dicarboxylic acids with the aromatic dicarboxylic acids (which are preferably terephthalic acid, isophthalic acid, t-butyl isophthalic acid, and the like; and lower alkyl esters of the above aromatic dicarboxylic acids, and the like). The amount of copolymerization of the aromatic dicarboxylic acid is preferably less than or equal to 20 mol %.

As for the polycarboxylic acid having a sulfonic acid group, for example, a carboxylic acid represented by the following general formula (1), or the like is available:

$$A(SO^{3-}X^{+})_nZ^2 \qquad \text{General Formula (1)}$$

In the general formula (1), "A" represents a hydrocarbon atomic group of a linear type, branched type, or cyclic type, or a hydrocarbon atomic group having all the types; "X" represents a monovalent cation of $H^+$, $Na^+$, $K^+$, or $Li^+$; "Z" represents a carboxyl group; and "n" represents an integer ranging from 1 to 3. Moreover, in the general formula (1), the carboxyl group represented by "Z" may be esterified to form an alkyl ester. Furthermore, the carboxyl groups represented by "Z" may be so-called anhydrides as the carboxyl groups are dehydrated to form a ring.

More specifically, the hydrocarbon atomic group represented by "A" in the general formula (1) may be: an arylene group with a carbon number of 6 to 24 (preferably with a carbon number of 6 to 12); a linear or branched alkylene group with a carbon number of 1 to 20 (preferably with a carbon number of 2 to 10); or the like. To be precise, among the hydrogen atoms contained in the above substances, "n" hydrogen atoms have been replaced with ($SO^{3-}X^{+}$). It is preferred that "n" in the general formula (1) be an integer ranging from 1 to 2.

For example, specific examples of the polycarboxylic acid having a sulfonic acid group include: 2-sulfoterephthalic acid sodium, 5-sulfoisophthalic acid sodium, sulfosuccinic acid sodium, anhydrides of the above substances, and lower alkyl esters of the above substances (alkyl esters with a carbon number of 1 to 4).

—Lactone Ring-Opening Polymerization Product—

The lactone ring-opening polymerization product is not specifically restricted. The lactone ring-opening polymerization product can be appropriately selected depending on the intended purpose. For example, the following are available among other things: lactone ring-opening polymerization products that are obtained by ring-opening polymerization of lactones like monolactones (The number of ester groups in the ring is one) with a carbon number of 3 to 12, such as β-propiolactone, γ-butyrolactone, δ-valerolactone, and ϵ-caprolactone, with the use of a catalyst such as metal oxide or organometallic compound; lactone ring-opening polymerization products that have a hydroxyl group at a terminal and are obtained by ring-opening polymerization of the monolactones with a carbon number of 3 to 12 with the use of a glycol (e.g. ethylene glycol, diethylene glycol, or the like) as initiator.

The monolactones with a carbon number of 3 to 12 are not specifically restricted. The monolactones can be appropriately selected depending on the intended purpose. In terms of crystallinity, ϵ-caprolactone is preferred.

Moreover, as for the lactone ring-opening polymerization products, commercialized products are available. For example, the commercialized products include highly-crystalline polycaprolactones, such as H1P, H4, H5, and H7 of the PLACCEL Series manufactured by Daicel Corporation.

—Polyhydroxy Carboxylic Acid—

A method of preparing the polyhydroxy carboxylic acid is not specifically restricted. The preparation method can be appropriately selected depending on the intended purpose. For example, the following methods are available among other things: a method of carrying out direct dehydration and condensation of hydroxycarboxylic acid such as glycolic acid and lactic acid (L-lactic acid, D-lactic acid, racemic lactic acid, or the like); and a method of carrying out ring-opening polymerization of cyclic esters (the number of ester groups in the ring is 2 or 3) with a carbon number of 4 to 12 that correspond to dehydration condensates between two or three molecules of hydroxycarboxylic acids such as glycolide and lactide (L-lactide, D-lactide, racemic lactide, or the like), with the use of a catalyst such as metal oxide or organometallic compound. Among the above methods, the ring-opening polymerization method is preferred in terms of adjustment of the molecular weight.

Among the cyclic esters, in terms of crystallinity, L-lactide and D-lactide are preferred. Moreover, polyhydroxy carboxylic acids of the above substances may be modified so as to have a terminal hydroxyl group or carboxyl group.

<<Polyurethane Resin>>

Examples of the polyurethane resin, the following are available among other things: polyurethane resins that are synthesized from a polyol, such as a diol and a trivalent or higher-valent polyol (preferably between the trivalent and the octavalent), and a polyisocyanate such as a diisocyanate and a trivalent or higher-valent polyisocyanate. Among the above polyurethane resins, a polyurethane resin that is synthesized from the diol and the diisocyanate is preferred.

As for the diol and the trivalent or higher-valent polyol (preferably between the trivalent and the octavalent), the same substances as the above-mentioned diol and trivalent or higher-valent polyol (preferably between the trivalent and the octavalent), which have been mentioned in explaining the polyester resin, are available.

—Polyisocyanate—

Examples of the polyisocyanate, for example, the following are available among other things: diisocyanates, and trivalent or higher-valent polyisocyanates.

The diisocyanates are not specifically restricted. The diisocyanates can be appropriately selected depending on the intended purpose. For example, the following are available among other things: aromatic diisocyanates, aliphatic diisocyanates, cycloaliphatic diisocyanates, and aromatic aliphatic diisocyanates. Among the above substances, the following are available: aromatic diisocyanates with a carbon number of 6 to 20 (except carbon atoms in a NCO group); aliphatic diisocyanates with a carbon number of 2 to 18; cycloaliphatic diisocyanates with a carbon number of 4 to 15; aromatic aliphatic diisocyanates with a carbon number of 8 to 15; modified products of the above diisocyanates (modified products that contain urethane groups, carbodiimide groups, allophanate groups, urea groups, viewlet groups, uretdione groups, uretoimin groups, isocyanurate groups, or oxazolidone groups, and the like); and mixtures of two or more of the above substances. Trivalent or higher-valent isocyanates may be used together with the is above substances when necessary.

The aromatic diisocyanates are not specifically restricted. The aromatic diisocyanates can be appropriately selected depending on the intended purpose. For example, the following are available among other things: 1,3-phenylene diisocyanate, 1,4-phenylene diisocyanate, 2,4-tolylene diisocyanate (TDI), 2,6-tolylene diisocyanate (TDI), crude TDI, 2,4'-diphenylmethane diisocyanate (MDI), 4,4'-diphenylmethane diisocyanate (MDI), crude MDI [phosgenation products of crude diaminophenyl methane {Condensation products of formaldehyde and aromatic amine (aniline) or the mixture thereof; the mixture of diaminodiphenylmethane and a small amount (e.g. 5% by mass to 20% by mass) of polyamines having three or more functional groups}: polyallyl polyisocyanate (PAPI)], 1,5-naphthylene diisocyanate, 4,4',4"-triphenylmethane triisocyanate, and m- and p-isocyanatophenyl sulfonyl isocyanate.

The aliphatic diisocyanates are not specifically restricted. The aliphatic diisocyanates can be appropriately selected depending on the intended purpose. For example, the following are available among other things: ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanatoethyl)fumarate, bis(2-isocyanatoethyl)carbonate, and 2-isocyanatoethyl-2,6-diisocyanato hexanoate.

The cycloaliphatic diisocyanates are not specifically restricted. The cycloaliphatic diisocyanates can be appropriately selected depending on the intended purpose. For example, the following are available among other things: isophorone diisocyanate (IPDI), dicyclohexylmethane-4,4'-diisocyanate (hydrogenated MDI), cyclohexylene diisocyanate, methyl cyclohexylene diisocyanate (hydrogenated TDI), bis(2-isocyanatoethyl)-4-cyclohexene-1,2-dicarboxylate, and 2,5- and 2,6-norbornane diisocyanate.

The aromatic aliphatic diisocyanates are not specifically restricted. The aromatic aliphatic diisocyanates can be appropriately selected depending on the intended purpose. For example, the following are available among other things: m- and p-xylylene diisocyanate (XDI), and α,α,α',α'-tetramethyl xylylene diisocyanate (TMXDI).

The modified products of diisocyanates are not specifically restricted. The modified products of diisocyanates can be appropriately selected depending on the intended purpose. For example, the following are available among other things: urethane group-containing modified products, carbodiimide group-containing modified products, allophanate group-containing modified products, urea group-containing modified products, beuret group-containing modified products, urethodione group-containing modified products, uretoimine group-containing modified products, isocyanurate group-containing modified products, and oxazolidone group-containing modified products. More specifically, the following are available among other things: modified MDI, such as urethane-modified MDI, carbodiimide-modified MDI, or trihydrocarbyl phosphate-modified MDI, and modified products of diisocyanates like urethane-modified TDI such as isocyanate-containing prepolymer; and mixtures of two or more types of the modified products of diisocyanates (e.g. the combination of modified MDI and urethane-modified TDI).

Among the diisocyanates, the following are preferred: aromatic diisocyanates with a carbon number of 6 to 15 (except carbon atoms in a NCO group), aliphatic diisocyanates with a carbon number of 4 to 12, and cycloaliphatic diisocyanates with a carbon number of 4 to 15. The following are particularly preferred: TDI, MDI, HDI, hydrogenated MDI, and IPDI.

<<<Polyurea Resin>>>

Examples of the polyurea resin, the following are available among other things: polyurea resins synthesized from polyamines, such as diamines and trivalent or higher-valent polyamines, and polyisocyanates, such as diisocyanates and trivalent or higher-valent polyisocyanates. Among the above substances, the polyurea resins synthesized from the diamines and the diisocyanates are preferred.

As for the diisocyanates and the trivalent or higher-valent polyisocyanates, the same substances as the above-mentioned diisocyanates and trivalent or higher-valent polyisocyanates, which have been mentioned in explaining the polyurethane resin, are available.

—Polyamine—

Examples of the polyamine, for example, the following are available among other things: diamines and trivalent or higher-valent polyamines.

The diamine is not specifically restricted. The diamine can be appropriately selected depending on the intended purpose. For example, the following are available among other things: aliphatic diamines, and aromatic diamines. Among the above substances, the following are preferred: aliphatic diamines with a carbon number of 2 to 18, and aromatic diamines with a carbon number of 6 to 20. Moreover, the trivalent or higher-valent amines may be used together with the above substances when necessary.

The aliphatic diamines with a carbon number of 2 to 18 are not specifically restricted. The aliphatic diamines can be appropriately selected depending on the intended purpose. For example, the following are available among other things: alkylene diamines with a carbon number of 2 to 6, such as ethylene diamine, propylene diamine, trimethylene diamine, tetramethylene diamine, and hexamethylene diamine; polyalkylene diamines with a carbon number of 4 to 18, such as diethylene triamine, iminobispropylamine, bis(hexamethylene)triamine, triethylenetetramine, tetraethylenepentamine, and pentaethylenehexamine; the alkylenediamines, such as dialkylamino propylamine, trimethyl hexamethylene diamine, aminoethylethanolamine, 2,5-dimethyl-2,5-hexamethylene diamine, and methyl iminobispropylamine, or alkyls with a carbon number of 1 to 4 of the polyalkylene diamines, or hydroxyalkyl substitutes with a carbon number of 2 to 4; cycloaliphatic diamines with a carbon number of 4 to 15, such as 1,3-diaminocyclohexane, isophoronediamine, menthenediamine, 4,4'-methylene dicyclohexane diamine (hydrogenated methylenedianiline); heterocyclic diamines with a carbon number of 4 to 15, such as piperazine, N-aminoethylpiperazine, 1,4-diaminoethyl piperazine, 1,4-bis(2-amino-2-methylpropyl) piperazine, 3,9-bis(3-aminopropyl)-2,4,8,10-tetraoxaspiro[5,5]undecane; aromatic ring-containing aliphatic amines with a carbon number of 8 to 15, such as xylylenediamine, and tetrachloro-p-xylylenediamine.

The aromatic diamines with a carbon number of 6 to 20 are not specifically restricted. The aromatic diamines can be appropriately selected depending on the intended purpose. For example, the following are available among other things: unsubstituted aromatic diamines, such as 1,2-phenylenediamine, 1,3-phenylenediamine, 1,4-phenylenediamine, 2,4'-diphenylmethanediamine, 4,4'-diphenylmethanediamine, crude diphenylmethane diamine (polyphenyl polymethylene polyamine), diaminodiphenyl sulfone, benzidine, thiodianiline, bis(3,4-diaminophenyl) sulfone, 2,6-diaminopyridine, m-aminobenzylamine, triphenylmethane-4,4',4"-triamine, and naphthylene diamine; aromatic diamines having nuclear-substituted alkyl groups with a carbon number of 1 to 4, such as 2,4-tolylenediamine, 2,6-tolylenediamine, crude tolylenediamine, diethyl tolylenediamine, 4,4'-diamino-3,3'-dimethyl diphenylmethane, 4,4'-bis(o-toluidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyl diphenylmethane, 3,3',5,5'-tetraethyl-4,4'-diaminobenzophenone, 3,3',5,5'-tetraethyl-4,4'-diaminodiphenylether, and 3,3',5,5'-tetraisopropyl-4,4'-diaminodiphenyl sulfone; mixtures of various proportions of isomers of aromatic diamines having the unsubstituted aromatic diamines and nuclear-substituted alkyl groups with a carbon number of 1 to 4; aromatic diamines having nuclear-substituted electron-withdrawing groups (halogen such as Cl, Br, I, or F; alkoxy groups such as methoxy or ethoxy; nitro groups or the like), such as methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-amino aniline; 4,4'-diamino-3,3'-dimethyl-5,5'-dibromo-diphenylmethane, 3,3'-dichlorobenzidine, 3,3'-dimethoxy benzidine, bis(4-amino-3-chlorophenyl) oxide, bis(4-amino-2-chlorophenyl) propane, bis(4-amino-2-chlorophenyl) sulfone, bis(4-amino-3-methoxyphenyl) decane, bis(4-aminophenyl) sulfide, bis(4-aminophenyl) telluride, bis(4-aminophenyl) selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), 4-aminophenyl-2-chloroaniline, and the like; and aromatic diamines having secondary amino groups, such as 4,4'-di(methylamino)diphenylmethane, and 1-methyl-2-methylamino-4-aminobenzene {the unsubstituted aromatic diamines, the aromatic diamines having nuclear-substituted alkyl groups with a carbon number of 1 to 4, and mixtures of various proportions of isomers of the above substances, and those made by replacing some or all of primary amino groups of the aromatic diamines having nuclear-substituted electron-withdrawing groups with secondary amino group with the help of lower alkyl groups such as methyl and ethyl}.

Examples of the diamines, in addition to the above substances, the following are available among other things: polyamidepolyamines such as low-molecular-weight polyamidepolyamines, which are obtained by condensation of dicarboxylic acid (dimer acid or the like) and an excess amount (2 or more moles per mole of acid) of the polyamine (the alkylenediamine, the polyalkylene polyamine, or the like); and polyether polyamines, such as hydrides of cyanoethylation products of polyether polyols (polyalkylene glycols, or the like).

<<<Polyamide Resin>>>

Examples of the polyamide resin, the following are available among other things: polyamide resins synthesized from polyamines such as diamines and trivalent or higher-valent polyamines, and polycarboxylic acids such as dicarboxylic acids and trivalent or higher-valent polycarboxylic acids (preferably between the trivalent and the hexavalent). Among the above substances, the polyamide resins synthesized from diamines and dicarboxylic acids are preferred.

Examples of the diamines and the trivalent or higher-valent polyamines, the same substances as the above-mentioned diamines and trivalent or higher-valent polyamines, which have been mentioned in explaining the polyurea resin, are available.

Examples of the dicarboxylic acids and the trivalent or higher-valent polycarboxylic acids (preferably between the trivalent and the hexavalent), the same substances as the dicarboxylic acids and trivalent or higher-valent polycarboxylic acids (preferably between the trivalent and the hexavalent), which have been mentioned in explaining the polyester resin, are available.

<<<Polyether Resin>>>

The polyether resin is not specifically restricted. The polyether resin can be appropriately selected depending on the intended purpose. For example, crystalline polyoxyalkylene polyol and the like are available.

A method of producing the crystalline polyoxyalkylene polyol is not specifically restricted. A conventionally, publicly known method can be appropriately selected depending on the intended purpose. For example, the following methods are available among other things: a method of carrying out ring-opening polymerization of AO of chiral with the use of a catalyst that is used for polymerization of normal AO (for example, the method disclosed in: "Journal of the American Chemical Society," 1956, Volume 78, No. 18, pp. 4787-4792); a method of carrying out ring-opening polymerization of AO of inexpensive racemate with the use of a complex of a sterically-bulky, special chemical structure as a catalyst.

As a method of using a special complex, the following methods are known among other things: a method of using, as a catalyst, a compound in which a lanthanoide complex and organoaluminum are in contact with each other (for example, see JP-A No. 11-12353); and a method of reacting bimetallic μ-oxo alkoxides with hydroxyl compounds in advance (for example, see JP-A No. 2001-521957).

As a method of obtaining crystalline polyoxyalkylene polyol of very high isotacticity, the following method is known: a method of using a salen complex as a catalyst (For example, See "Journal of the American Chemical Society," 2005, Volume 127, No. 33, pp. 11566-11567). For example, if AO of chiral is used, and if water or glycol is used as an initiator at the time of ring-opening polymerization thereof, what is obtained is a polyoxyalkylene glycol that has a hydroxyl group at a terminal with an isotacticity of 50% or more. The polyoxyalkylene glycol with an isotacticity of 50% or more may be so modified that the terminal thereof is turned into a carboxyl group, for example. Incidentally, if the isotacticity is 50% or more, the polyoxyalkylene glycol is usually crystalline. Example of the glycol, the diol or the like is available. Example of a carboxylic acid that is used for carboxy modification, the dicarboxylic acid or the like is available.

As for AO that is used for production of the crystalline polyoxyalkylene polyol, those with a carbon number of 3 to 9 are available. For example, the following are available among other things: PO, 1-chloro-oxetane, 2-chloro-oxetane, 1,2-dichloro-oxetane, epichlorohydrin, epibromohydrin, 1,2-BO, methyl glycidyl ether, 1,2-pentylene oxide, 2,3-pentylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-pentylene oxide, allylglycidylether, 1,2-heptylene oxide, styrene oxide, and phenylglycidylether. Among the above AOs, PO, 1,2-BO, styrene oxide, and cyclohexene oxide are preferred; PO, 1,2-BO, and cyclohexene oxide are even more preferred. One of the above AOs may be used independently, or two or more of the above AOs may be used in combination.

In terms of the high-sharp melt performance and blocking resistance of the obtained crystalline polyether resin, the isotacticity of the crystalline polyoxyalkylene polyol is preferably 70% or more, more preferably 80% or more, even more preferably 90% or more, particularly preferably 95% or more.

The isotacticity can be calculated by the method disclosed in: Macromolecules, Vol. 35, No. 6, pp. 2389-2392 (2002). The isotacticity can be calculated in the following manner.

About 30 mg of a measurement sample is weighed into a $^{13}$C-NMR sample tube with a diameter of 5 mm. About 0.5 mL of deuteration solvent is added to dissolve the sample. In this manner, a sample for analysis is prepared. In this case, the deuteration solvent is not specifically restricted; a solvent that can dissolve the sample can be appropriately selected. For example, the following are available among other things: deuterated chloroform, deuterated toluene, deuterated dimethyl sulfoxide, and deuterated dimethyl formamide. Signals derived from three types of methine groups of $^{13}$C-NMR can be observed around a syndiotactic value (5) of 75.1 ppm, around a heterotactic value (H) of 75.3 ppm, and around an isotactic value (I) of 75.5 ppm.

The isotacticity is calculated by the following formula (1):

$$\text{Isotacticity}(\%)=[I/(I+S+H)]\times 100 \qquad \text{Formula (1)}$$

In the formula (1), "I" represents an integral value of the isotactic signal; "S" represents an integral value of the syndiotactic signal; "H" represents an integral value of the heterotactic signal.

<<<Vinyl Resin>>>

The vinyl resin is not specifically restricted as long as the vinyl resin has crystallinity. The vinyl resin can be appropriately selected depending on the intended purpose. Those made up of a vinyl monomer that has crystallinity, and a vinyl monomer that does not have crystallinity when necessary are preferred.

The vinyl monomer having crystallinity is not specifically restricted. The vinyl monomer can be appropriately selected depending on the intended purpose. The following are preferred: linear alkyl(meth)acrylate whose alkyl group's carbon number is 12 to 50 (a linear alkyl group with a carbon number of 12 to 50 is a crystalline group), such as lauryl(meth)acrylate, tetradecyl(meth)acrylate, stearyl(meth)acrylate, eicosyl (meth)acrylate, and behenyl(meth)acrylate.

The vinyl monomer not having crystallinity is not specifically restricted. The vinyl monomer can be appropriately selected depending on the intended purpose. A vinyl monomer with a molecular weight of 1,000 or less is preferred. For example, the following are available among other things: styrenes, (meth)acrylic monomer, carboxyl group-containing vinyl monomer, other vinyl ester monomers, and aliphatic hydrocarbon vinyl monomer. One of the above substances may be used independently, or two or more of the above substances may be used in combination.

The styrenes are not specifically restricted. The styrenes can be appropriately selected depending on the intended purpose. For example, the following are available among other things: styrene, and alkylstyrene whose alkyl group's carbon number is 1 to 3.

The (meth)acrylic monomer is not specifically restricted. The (meth)acrylic monomer can be appropriately selected depending on the intended purpose. For example, the following are available among other things: alkyl(meth)acrylates whose alkyl group's carbon number is 1 to 11, such as methyl (meth)acrylate, ethyl(meth)acrylate, butyl(meth)acrylate, and 2-ethylhexyl(meth)acrylate, and branched alkyl(meth) acrylates whose alkyl group's carbon number is 12 to 18; hydroxyalkyl(meth)acrylates whose alkyl group's carbon number is 1 to 11, such as hydroxyethyl(meth)acrylate; alkylamino group-containing (meth)acrylates whose alkyl group's carbon number is 1 to 11, such as dimethylaminoethyl(meth)acrylate, and diethylaminoethyl(meth)acrylate.

The carboxyl group-containing vinyl monomer is not specifically restricted. The carboxyl group-containing vinyl monomer can be appropriately selected depending on the intended purpose. For example, the following are available among other things: monocarboxylic acids with a carbon number of 3 to 15, such as (meth)acrylic acid, crotonic acid, and cinnamic acid; dicarboxylic acids with a carbon number of 4 to 15, such as maleic (anhydride), fumaric acid, itaconic acid, and citraconic acid; and dicarboxylic acid monoesters like monoalkyl esters (with a carbon number of 1 to 18) of the dicarboxylic acid, such as maleic acid monoalkyl ester, fumaric acid monoalkyl ester, itaconic acid monoalkyl ester, and citraconic acid monoalkyl ester.

The other vinyl ester monomer is not specifically restricted. The other vinyl ester monomer can be appropriately selected depending on the intended purpose. For example, the following are available among other things: aliphatic vinyl esters with a carbon number of 4 to 15, such as vinyl acetate, vinyl propionate, and isopropenyl acetate; polyhydric alcohol esters (dihydric to trihydric, or higher) of unsaturated carboxylic acid with a carbon number of 8 to 50, such as ethylene glycol di(meth)acrylate, propylene glycol di(meth)acrylate, neopentyl glycol di(meth)acrylate, trimethylolpropane tri(meth)acrylate, 1,6-hexanediol diacrylate, and polyethylene glycol di(meth)acrylate; aromatic vinyl esters with a carbon number of 9 to 15, such as methyl-4-vinyl benzoate.

The aliphatic hydrocarbon vinyl monomer is not specifically restricted. The aliphatic hydrocarbon vinyl monomer can be appropriately selected depending on the intended purpose. For example, the following are available among other things: olefins with a carbon number of 2 to 10, such as ethylene, propylene, butene, and octene; and dienes with a carbon number of 4 to 10, such as butadiene, isoprene, and 1,6-hexadiene.

<<<Modified Crystalline Resin (Binder Resin Precursor)>>>

The modified crystalline resin is not specifically restricted as long as the modified crystalline resin is a crystalline resin having a functional group capable of reacting with active hydrogen groups. The modified crystalline resin can be appropriately selected depending on the intended purpose. For example, the following are available among other things: a crystalline polyester resin having a functional group capable of reacting with the active hydrogen groups, a crystalline polyurethane resin having a functional group capable of reacting with the active hydrogen groups, a crystalline polyurea resin having a functional group capable of reacting with the active hydrogen groups, a crystalline polyamide resin having a functional group capable of reacting with the active hydrogen groups, a crystalline polyether resin having a functional group capable of reacting with the active hydrogen groups, and a crystalline vinyl resin having a functional group capable of reacting with the active hydrogen groups. In the process of producing the toner, the modified crystalline resin is reacted with a resin having active hydrogen groups, or a cross-linking agent having active hydrogen groups, or a compound having active hydrogen groups such as an extension agent. In this manner, the high-molecular-weight resin is obtained, and the binder resin can be formed. Therefore, the modified crystalline resins can be used as binder resin precursor in the process of producing the toner.

Incidentally, the binder resin precursors mean monomers and oligomers that make up the above binder resin, a modified resin having a functional group capable of reacting with the active hydrogen groups, and a compound by which extension or cross-linking reaction is possible including oligomers. Among the above substances, as the binder resin precursor, the modified crystalline resin having at least an isocyanate group at a terminal is preferred. It is preferred that, when toner particles are granulated in an aqueous medium by dispersing or emulsifying, the binder resin be formed by reaction with active hydrogen groups and by extension or cross-linking reaction.

Examples of the binder resin that is made from the binder resin precursor, the following are preferred: crystalline resins made by extension or cross-linking reaction of a modified resin having a functional group capable of reacting with the active hydrogen groups, and a compound having the active hydrogen groups. Among the above substances, the following are preferred: a urethane-modified polyester resin made by extension or cross-linking reaction of a polyester resin having an isocyanate group at a terminal, and the polyol; a urea-modified polyester resin made by extension or cross-linking reaction of a polyester resin having an isocyanate group at a terminal, and amines or water.

The functional group capable of reacting with the active hydrogen groups is not specifically restricted. The functional group can be appropriately selected depending on the intended purpose. For example, the following are available among other things: functional groups, such as isocyanate groups, epoxy groups, carboxylic acids, and acid chloride groups. Among the above groups, the isocyanate groups and the like are preferred in terms of reactivity and stability.

The compound having the active hydrogen groups is not specifically restricted as long as the compound has the active hydrogen groups. The compound can be appropriately selected depending on the intended purpose. For example, if the functional group capable of reacting with the active hydrogen groups is an isocyanate group, the following are available among other things: compounds having, as the active hydrogen groups, hydroxyl groups (alcoholic hydroxyl groups and phenolic hydroxyl groups), amino groups, carboxyl groups, mercapto groups, and the like. Among the above substances, in terms of reaction rate, the compounds having amino groups (i.e., amines) are particularly preferred.

The amines are not specifically restricted. The amines can be appropriately selected depending on the intended purpose. For example, the following are available among other things: phenylenediamine, diethyltoluenediamine, 4,4'-diaminodiphenylmethane, 4,4'-diamino-3,3'-dimethyl dicyclohexylmethane, diamine cyclohexane, isophoronediamine, ethylenediamine, tetramethylene diamine, hexamethylene diamine, diethylene triamine, triethylenetetramine, ethanolamine, hydroxyethylaniline, amino ethyl mercaptan, aminopropyl mercaptan, aminopropionic acid, and aminocaproic acid. Moreover, the following are also available among other things: those in which the amino groups of the amines are blocked by ketones (acetone, methyl ethyl ketone, methyl isobutyl ketone, and the like), such as ketimine compounds and oxazoline compounds.

The crystalline resin may be a block resin having crystalline and non-crystalline portions. For the crystalline portion, the crystalline resins can be used. A resin that is used for formation of the non-crystalline portion is not specifically restricted. The resin can be appropriately selected depending on the intended purpose. For example, the following are available among other things: polyester resin, polyurethane resin, polyurea resin, polyamide resin, polyether resin, vinyl resin (polystyrene, styrene acrylic polymer, and the like), and epoxy resin.

However, the crystalline portion is preferably made from at least one of the following: polyester resin, polyurethane resin, polyurea resin, polyamide resin, and polyether resin. In terms of compatibility, as for the resin that is used for formation of the non-crystalline portion, the following are preferred: polyester resin, polyurethane resin, polyurea resin, polyamide resin, polyether resin, and a composite resin of the above. Polyurethane resin and polyester resin are even more preferred. The composition of the non-crystalline portion is not specifically restricted as long as an amorphous resin is obtained. Any combination can be appropriately selected depending on the intended purpose. As for the monomers used, for example, the following are available among other things: the polyols, the polycarboxylic acids, the polyisocyanates, the polyamines, and the AOs.

<<Amorphous Resin>>

The amorphous resin is not specifically restricted as long as the resin is amorphous. From among the publicly-known resins, the amorphous resin can be appropriately selected depending on the intended purpose. For example, the following are available among other things: styrenes such as polystyrene, poly-p-styrene, and polyvinyl toluene or homopolymer of substitutes thereof, styrene-p-chlorostyrene copolymer, styrene-propylene copolymer, styrene-vinyl toluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-α-chlor methacrylic acid methyl copolymer, styrene-acrylonitrile copolymer, styrene-vinyl methyl ether copolymer, styrene-vinyl methyl ketone copolymer, styrene-butadiene copolymer, styrene-isopropyl copolymer, styrene-maleic acid ester copolymer, and other styrene copolymers, polymethylmethacrylate resin, polybutylmethacrylate resin, polyvinyl chloride resin, polyvinyl acetate resin, polyethylene resin, polyester resin, polyurethane resin, epoxy resin, polyvinyl butyral resin, polyacrylic resin, rosin resin, modified rosin resin, terpene resin, phenolic resin, aliphatic or aromatic hydrocarbon resins, aromatic petroleum resin, and the like, and the resins that are so modified as to have a functional group capable of reacting with active hydrogen groups. One of the above substances may be used independently, or two or more of the above substances may be used in combination.

<Organically-Modified Layered Inorganic Mineral>

The organically-modified layered inorganic mineral is not specifically restricted. The organically-modified layered inorganic mineral can be appropriately selected depending on the intended purpose. The following is preferred: an organically-modified layered inorganic mineral in which at least some of ions between layers of the layered inorganic mineral are modified with organic ions. The layered inorganic mineral is a layered inorganic mineral that is made up of layers with an average thickness of several nanometers that are stacked. The "modified" means that organic ions are introduced into ions between layers of the layered inorganic mineral. That is, the "modified" at least means that some of ions between layers of the layered inorganic mineral are replaced with organic ions, or that organic ions are further introduced into between layers of the layered inorganic mineral. The "modified" is broadly interpreted as intercalation.

According to the present invention, in the toner that contains 50% by mass or more of the crystalline resin relative to the binder resin, the following is contained: an organically-modified layered inorganic mineral in which at least some of ions between layers of the layered inorganic mineral are modified with organic ions. Therefore, it is found that it is possible to add stress resistance of the same level as conventional technology, and that, unlike the conventional technology, it is possible to avoid the occurrence of image-transport scratches that could occur during the recrystallization immediately after heat fixing, and the lack of the hardness of an output image.

The layered inorganic mineral is most effective at a time when the layered inorganic mineral is disposed in such a way as to be finely dispersed in the vicinity of a surface layer of a toner. According to the present invention, it is known that the organically-modified layered inorganic mineral has been finely dispersed and disposed evenly in the vicinity of the surface layer of the toner with no space. Therefore, the structural viscosity of the binder resin in the vicinity of the surface layer of the toner is efficiently increased, and an image is sufficiently protected even in the situation immediately after fixation, or in the situation where the image is low in resin hardness. Moreover, the layered inorganic mineral can exert effects in an efficient manner even when the amount of the layered inorganic mineral added is small. Therefore, inhibition of the fixation performance is considered almost nonexistent. The fine dispersing is realized by sulfonic acid groups of a resin having sulfonic acid groups. That is, the sulfonic acid groups of the resin having the sulfonic acid groups contribute to the fine dispersing of the organically-modified layered inorganic mineral.

The state of existence of the organically-modified layered inorganic mineral in the toner can be confirmed by cutting a sample in which toner particles are embedded in epoxy resin and the like with the use of micromicrotome or ultramicrotome, and observing the cross-sectional surface of the cut toner with the use of a scanning electron microscope (SEM) or the like. When the observation is carried out with the SEM, a backscattered electron image is preferably used for confirmation because the existence of the organically-modified layered inorganic mineral can be observed in strong contrast. FIB-STEM (HD-2000, manufactured by Hitachi, Ltd.) may be used to cut a sample in which toner particles are embedded in epoxy resin and the like with the use of ion beam, and observe the cross-sectional surface of the cut toner. Even in this case, a backscattered electron image is preferably used for confirmation because the image is easy to visually confirm. Moreover, a sample that is cut by micromicrotome or ultramicrotome into ultrathin pieces may be confirmed by a transmission electron microscope (TEM). In this case, the ultrathin pieces are stained with a stain such as ruthenium tetroxide or osmium tetroxide to make it easier to visually confirm the organically-modified layered inorganic mineral.

According to the present invention, the vicinity of the surface of the toner is defined as a 0 nm to 300 nm area inside the toner from the outermost surface of the toner in an observation image of the cross-sectional surface of the toner that passes through a central portion of the toner, which is obtained by cutting a sample in which toner particles are embedded in epoxy resin and the like with the use of micromicrotome, ultramicrotome, or FIB-STEM.

The layered inorganic mineral is not specifically restricted. The layered inorganic mineral can be appropriately selected depending on the intended purpose. For example, the following are available among other things: smectite-group clay minerals (montmorillonite, saponite, hectorite, and the like), kaolin-group clay minerals (kaolinite and the like), bentonite, attapulgite, magadiite, and kanemite. One of the above substances may be used independently, or two or more of the above substances may be used in combination.

The organically-modified layered inorganic mineral is not specifically restricted. The organically-modified layered inorganic mineral can be appropriately selected depending on the intended purpose. The following are preferred: the organically-modified layered inorganic minerals in which at least some of ions between layers of the layered inorganic mineral are modified with organic cation or organic anion. Among the above substances, the following are preferred in terms of dispersion stability in the vicinity of the surface of the toner: the organically-modified layered inorganic minerals in which at least some of ions between layers of a smectite-group clay mineral, which has a basic crystal structure of smectite, are modified with organic cation. The following are more preferred: the organically-modified layered inorganic minerals in which at least some of ions between layers of montmorillonite are modified with organic cation; and the organically-modified layered inorganic minerals in which at least some of ions between layers of bentonite are modified with organic cation. The following are particularly preferred: organically-modified montmorillonite, such as stearalkonium bentonite and quaternium 18/benzalkonium bentonite.

As for the organically-modified layered inorganic mineral, for example, the following are available among other things: layered inorganic compounds that are made by replacing some of divalent metals of the layered inorganic mineral with trivalent metals to introduce metal anions, and then replacing at least some of the metal anions with organic anions.

In the organically-modified layered inorganic mineral, the fact that at least some of ions between layers of the layered inorganic mineral have been modified with organic ions can be confirmed by gas choromatography mass spectrometry (GCMS). For example, the following method is preferred: a method of filtering a solution that is made by dissolving the binder resin of the toner, which is a sample, in a solvent, carrying out thermal decomposition of the solid obtained with the use of a thermal decomposition device, and identifying the organic matter by GCMS. More specifically, the following method is available: a method of using Py-2020D (manufactured by Frontier Laboratories Ltd.) as the thermal decomposition device, carrying out thermal decomposition at 550° C., and using GCMS device QP5000 (manufactured by Shimadzu Corporation) to identify.

Examples of the organically-modified layered inorganic mineral, commercialized products are available. For example, the commercialized products include: quaternium-18 bentonites, such as BENTONE 3, BENTONE 38, and BENTONE 38V (manufactured by Rheox Corp.), TIXOGEL VP (manufactured by United catalyst), CLAYTONE 34, CLAYTONE 40, and CLAYTONE XL (manufactured by Southern Clay Product, Inc.); stearalkonium bentonites, such as BENTONE 27 (manufactured by Rheox Corp.), TIXOGEL LG (manufactured by United catalyst), CLAYTONE AF and CLAYTONE APA (manufactured by Southern Clay Product, Inc.); quaternium-18/benzalkonium bentonite, such as CLAYTONE HT and CLAYTONE PS (manufactured by Southern Clay Product, Inc.); organically modified montmorillonites, such as CLAYTONE HY (manufactured by Southern Clay Product, Inc.); and organically modified smectites, such as LUCENTITE SPN (manufactured by Co-op Chemical Co., Ltd.). Among the above substances, CLAYTONE AF, CLAYTONE APA, and CLAYTONE HY are particularly preferred.

Examples of the organically-modified layered inorganic mineral, the following are particularly preferred: those made from DHT-4A (manufactured by Kyowa Chemical Industry Co., Ltd.) that is modified with a compound having the organic ion represented by $R_1(OR_2)nOSO_3M$ ("$R_1$" is an alkyl group with a carbon number of 13, "$R_2$" is an alkylene group with a carbon number of 2 to 6, and "n" is an integer ranging from 2 to 10, and "M" is a monovalent metal element). As for the compound having the organic ion represented by $R_1(OR_2)nOSO_3M$, for example, the following is available among other things: HITENOL 330T (manufactured by DAI-ICHI KOGYO SEIYAKU CO., LTD.).

The organically-modified layered inorganic mineral may be mixed with a resin for masterbatch, and be used as composite masterbatch. The masterbatch resin is not specifically restricted. The masterbatch resin can be appropriately selected from among those publicly known depending on the intended purpose. There is no problem even if the masterbatch resin is the binder resin such as the crystalline resin of the present invention.

The amount of the organically-modified layered inorganic mineral contained relative to the toner is preferably 0.1% by mass to 3.0% by mass, more preferably 0.5% by mass to 2.0% by mass, particularly preferably 1.0% by mass to 1.5% by mass. If the amount contained is less than 0.1% by mass, the organically-modified layered inorganic mineral has difficulty being effective. If the amount contained is greater than 3.0% by mass, the low-temperature fixation performance tends to be inhibited.

An organic ion modifying agent that has the organic ions and is a compound able to modify at least some of ions between layers of the layered inorganic mineral into organic ions is not specifically restricted. The organic ion modifying agent can be appropriately selected depending on the intended purpose. For example, the following are available among other things: quaternary alkyl ammonium salts, phosphonium salts, and imidazolium salts; sulfates having such skeletons as branched, unbranched or cyclic alkyl with a carbon number of 1 to 44, branched, unbranched or cyclic alkenyl with a carbon number of 1 to 22, branched, unbranched or cyclic alkoxy with a carbon number of 8 to 32, branched, unbranched or cyclic hydroxyalkyl with a carbon number of 2 to 22, ethylene oxide, and propylene oxide, sulfonates having the above skeletons, carboxylates having the above skeletons, and phosphates having the above skeletons. Among the above substances, quaternary alkyl ammonium salts, and a carboxylic acid having an ethylene oxide skeleton are preferred. Quaternary alkyl ammonium salts are particularly preferred. One of the above substances may be used independently, or two or more of the above substances may be used in combination.

As for the quaternary alkyl ammonium, for example, the following are available among other things: trimethyl stearyl ammonium, dimethyl stearyl benzyl ammonium, dimethyl octadecyl ammonium, and oleylbis(2-hydroxyethyl) methyl ammonium.

An amount modified by the organic ions in the organically-modified layered inorganic mineral is not specifically restricted. The amount can be appropriately selected depending on the intended purpose. Relative to the layered inorganic mineral, the amount is preferably 5% by mass to 60% by mass, more preferably 25% by mass to 45% by mass. If the amount modified is within the preferred range, the organically-modified layered inorganic mineral is easily disposed evenly in the vicinity of the surface layer of the toner. If the amount modified is within the more preferred range, the organically-modified layered inorganic mineral is disposed even more evenly.

<Colorant>

The colorant is not specifically restricted. The colorant can be appropriately selected from among publicly-known dyes and pigments depending on the intended purpose. For example, the following are available among other things: carbon black, nigrosine dye, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fiser Red, parachloroorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, pigment blue, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine blue, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and the like. One of the above substances may be used independently, or two or more of the above substances may be used in combination.

The color of the colorant is not specifically restricted. The color of the colorant can be appropriately selected depending on the intended purpose. For example, the colorants of colors such as black, magenta, cyan, and yellow are available. One of the above colorants may be used independently, or two or more of the above colorants may be used in combination.

The amount of the colorant contained in the toner is not specifically restricted. The amount can be appropriately selected depending on the intended purpose. The amount is preferably 1% by mass to 15% by mass, more preferably 3% by mass to 10% by mass. If the amount contained is less than 1% by mass, there is a decrease in the tinting strength of the toner. If the amount is greater than 15% by mass, poor dispersion of the pigment occurs in the toner, possibly resulting in a decrease in the tinting strength and in the electrical properties of the toner.

The colorant may be used as a masterbatch that has been combined with a resin for masterbatch. The masterbatch resin is not specifically restricted. The masterbatch resin can be appropriately selected from among those publicly known depending on the intended purpose. For example, the following are available among other things: styrene or polymers of substitutes thereof, styrene-based copolymer, polymethyl methacrylate resin, polybutyl methacrylate resin, polyvinyl chloride resin, polyvinyl acetate resin, polyethylene resin, polypropylene resin, polyester resin, epoxy resin, epoxy polyol resin, polyurethane resin, polyamide resin, polyvinyl butyral resin, polyacrylic resin, rosin, modified rosin, terpene resin, aliphatic hydrocarbon resin, alicyclic hydrocarbon resin, aromatic petroleum resin, chlorinated paraffin, and paraffin. One of the above substances may be used independently, or two or more of the above substances may be used in combination.

Examples of the styrene or polymers of substitutes thereof, for example, the following are available among other things: polyester resin, polystyrene resin, poly p-chlorostyrene resin, and polyvinyl toluene resin. Examples of the styrene-based copolymer, for example, the following are available among other things: styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chlor methyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer.

There is no problem even if the masterbatch resin is the binder resin such as the crystalline resin of the present invention.

The masterbatch can be produced by mixing or kneading of the masterbatch resin and the colorant with high shear applied. At this time, in order to increase the interaction between the colorant and the resin, an organic solvent is preferably added. A so-called flashing method is preferred because wet cake of the colorant can be used without being changed, and drying is not required. The flashing method is a method of mixing or kneading aqueous paste, which contains water of the colorant, along with the resin and the organic solvent, and shifting the colorant into the resin's side to remove water and the organic solvent component. For the mixing or kneading, for example, a high shear dispersing device, such as three roll mill, is preferably used.

<Other Ingredients>

In addition to the binder resin, the colorant, and the organically-modified layered inorganic mineral, the toner of the present invention may contain the following other ingredients when necessary as long as the effects of the present invention are not impaired: release agents, charge control agents, external additives, flowability improvers, cleaning improving agents, and magnetic materials.

<<Release Agent>>

The release agent is not specifically restricted. The release agent can be appropriately selected from among those publicly known depending on the intended purpose. For example, the following are available among other things: waxes, such as carbonyl group-containing wax, polyolefin wax, and long-chain hydrocarbon. One of the above substances may be used independently, or two or more of the above substances may be used in combination. Among the above substances, long-chain hydrocarbon is preferred.

As for the long-chain hydrocarbon, for example, the following are available among other things: paraffin wax and SASOL WAX.

The melting point of the release agent is not specifically restricted. The melting point can be appropriately selected depending on the intended purpose. The melting point is preferably 40° C. to 160° C., more preferably 50° C. to 120° C., particularly preferably 60° C. to 90° C. If the melting point is less than 40° C., the heat-resistant storage stability can be adversely affected. If the melting point is greater than 160° C., a cold offset is likely to occur at the time of low-temperature fixation.

For example, the melting point of the release agent can be calculated in the following manner: the temperature of a sample is increased to 200° C. with the use of a differential scanning calorimeter (DSC210, manufactured by SEIKO Electronics Industrial Co., Ltd.), and the sample is then cooled from the temperature to 0° C. at a temperature-drop rate of 10° C. per minute, and the temperature of the sample is then raised at a temperature-rise rate of 10° C. per minute, and the maximum peak temperature of the heat of fusion is calculated as the melting point.

As a measurement value at a temperature 20° C. higher than the melting point of the wax, the melt viscosity of the release agent is preferably 5 cps to 1,000 cps, more preferably 10 cps to 100 cps. If the melt viscosity is less than 5 cps, the release performance may drop. If the melt viscosity is greater than 1,000 cps, the effects of improving the hot-offset resistance and the low-temperature fixation performance may not be obtained.

The amount of the release agent contained in the toner is not specifically restricted. The amount can be appropriately selected depending on the intended purpose. The amount is preferably 0% by mass to 40% by mass, more preferably 3% by mass to 30% by mass. If the amount contained is greater than 40% by mass, the fluidity of the toner can deteriorate.

<<Charge Control Agent>>

The charge control agent is not specifically restricted. The charge control agent can be appropriately selected from among those publicly known depending on the intended purpose. Because the use of a colored material can cause a change in color tone, a colorless material, or a material close to white, is preferred. For example, such charge control agents include: triphenylmethane dyes, molybdic acid chelate pigments, rhodamine dyes, alkoxy amines, quaternary ammonium salts (including fluorine-modified quaternary ammonium salts), alkylamide, phosphorus itself or compounds thereof, tungsten itself or compounds thereof, fluorosurfactants, salicylic acid metal salts, and metal salts of salicylic acid derivatives. One of the above substances may be used independently, or two or more of the above substances may be used in combination.

The charge control agent may be dissolved or dispersed after being melt-blended with the masterbatch. Alternatively, the charge control agent may be added when being dissolved or dispersed together with each component of the toner. Alternatively, the charge control agent may be fixed onto the surface of the toner after toner particles are produced.

The amount of the charge control agent contained in the toner varies according to the type of the binder resin, whether additives exist or not, the dispersion method, and the like. The amount of the charge control agent therefore cannot be defined unconditionally. For example, relative to 100 parts by mass of the binder resin, the amount of the charge control agent is preferably 0.1 parts by mass to 10 parts by mass, more preferably 0.2 parts by mass to 5 parts by mass. If the amount contained is less than 0.1 parts by mass, the charge control performance may not be obtained. If the amount contained is greater than 10 parts by mass, the electrification characteristic of the toner becomes too large, reducing the effects of the main charge control agent. Moreover, the electrostatic attractive force with the developing roller may increase, possibly resulting in a decrease in the fluidity of the developer and a decrease in image density.

<<External Additive>>

The external additive is not specifically restricted. The external additive can be appropriately selected from among those publicly known depending on the intended purpose. For example, the following are available among other things: silica fine particles, hydrophobic silica fine particles, metal salts of fatty acids (e.g., zinc stearate, aluminum stearate, and the like); metal oxide (e.g., titanium oxide, alumina, tin oxide, antimony oxide, and the like), hydrophobic metal oxide fine particles, and fluoropolymer. Among the above substances, the following are preferred: hydrophobic silica fine particles, hydrophobic titanium oxide fine particles, and hydrophobic alumina fine particles.

The amount of the external additive added relative to the toner is preferably 0.1% by mass to 5% by mass, more preferably 0.3% by mass to 3% by mass.

As the external additive, resin fine particles may also be added. As the resin fine particles, for example, the following are available among other things: polystyrene obtained by soap-free emulsion polymerization, suspension polymerization, or dispersion polymerization; copolymer of methacrylic acid ester, and acrylic acid ester; polycondensation polymer particles, such as silicone, benzoguanamine, and nylon; and polymer particles made of thermosetting resin. The electrification characteristic of the toner can be enhanced as such resin fine particles are also used. It is possible to reduce oppositely-charged toner, and reduce background dirt. The amount of the resin fine particles added relative to the toner is preferably 0.01% by mass to 5% by mass, more preferably 0.1% by mass to 2% by mass.

<<Flowability Improver>>

The flowability improver means an improver that is used to carry out surface treatment of the toner to improve hydrophobicity, and is able to prevent deterioration of flow characteristics and charging characteristics of the toner even under high humidity. For example, the following are available among other things: silane coupling agents, silylation agents, silane coupling agents having fluorinated alkyl groups, organic titanate coupling agents, aluminum coupling agent, silicone oil, and modified silicone oil.

<<Cleaning Improving Agent>>

The cleaning improving agent is added to the toner to remove the developer after the transfer, which remains in an electrostatic latent image bearing member or an intermediate transfer member. For example, the following are available among other things: metal salts of fatty acids, such as zinc stearate, calcium stearate, and stearic acid; and polymer fine particles produced by soap-free emulsion polymerization, such as polymethylmethacrylate fine particles and polystyrene fine particles. As for the polymer fine particles, those with a relatively narrow particle size distribution are preferred. Those with a weight average particle diameter of 0.01 μm to 1 μm are preferred.

<<Magnetic Material>>

The magnetic material is not specifically restricted. The magnetic material can be appropriately selected from among those publicly known depending on the intended purpose. For example, the following are available among other things: iron powder, magnetite, and ferrite. Among the above substances, white substances are preferred in terms of color tone.

<<Characteristics of Toner>>

In order for the toner of the present invention to achieve high levels of both the low-temperature fixation performance and the heat-resistant storage stability and to be excellent in hot-offset resistance, if the heat-of-fusion maximum peak temperature of the toner measured by a differential scanning calorimeter is represented by Ta (° C.), and the softening temperature measured by a high load-type flow tester by Tb (° C.), the following are preferably satisfied: $45 \leq Ta \leq 70$, $0.8 \leq Tb/Ta \leq 1.55$. Moreover, if the storage elastic modulus of the toner at (Ta+20)° C. is represented by G'(Ta+20) (Pa·s), and the loss elastic modulus at (Ta+20)° C. by G"(Ta+20) (Pa·s), the following are preferably satisfied: $1.0\times10^3 \leq G'(Ta+20) \leq 5.0\times10^6$, $1.0\times10^3 \leq G''(Ta+20) \leq 5.0\times10^6$.

The heat-of-fusion maximum peak temperature (Ta) of the toner is not specifically restricted. The heat-of-fusion maximum peak temperature can be appropriately selected depending on the intended purpose. The heat-of-fusion maximum peak temperature is preferably 45° C. to 70° C., more preferably 53° C. to 65° C., particularly preferably 58° C. to 62° C. If the above Ta is between 45° C. and 70° C., the minimum level of heat-resistant storage stability required for the toner can be secured, and the toner that is, unlike the conventional one, excellent in low-temperature fixation performance can be obtained. If the Ta is less than 45° C., the low-temperature fixation performance is good, but the heat-resistant storage stability would deteriorate. If the Ta is greater than 70° C., the heat-resistant storage stability is good, but the low-temperature fixation performance would deteriorate.

The ratio (Tb/Ta) of the softening temperature (Tb) of the toner to the heat-of-fusion maximum peak temperature (Ta) is not specifically restricted. The ratio can be appropriately selected depending on the intended purpose. The ratio is preferably 0.8 to 1.55, more preferably 0.85 to 1.25, even more preferably 0.9 to 1.2, particularly preferably 0.9 to 1.19. As the Tb becomes smaller, the resin has such properties as to be steeply softened, and is excellent in achieving both the low-temperature fixation performance and the heat-resistant storage stability.

As for the viscoelastic properties of the toner, it is preferred that the storage elastic modulus G' (Ta+20) at (Ta+20)° C. be $1.0\times10^3$ Pa·s to $5.0\times10^6$ Pa·s in terms of the fixing strength and the hot-offset resistance. It is more preferred that the storage elastic modulus G' (Ta+20) be $1.0\times10^4$ Pa·s to $5.0\times10^5$ Pa·s. Moreover, it is preferred that the loss elastic modulus G"(Ta+20) at (Ta+20)° C. be $1.0\times10^3$ Pa·s to $5.0\times10^6$ Pa·s in terms of the hot-offset resistance. It is more preferred that the loss elastic modulus G"(Ta+20) be $1.0\times10^4$ Pa·s to $5.0\times10^5$ Pa·s.

If the loss elastic modulus of the toner at (Ta+30)° C. is represented by G" (Ta+30)(Pa·s), the loss elastic modulus at (Ta+70)° C. by G" (Ta+70)(Pa·s), the following is preferred: $0.05 \leq [G''(Ta+30)/G''(Ta+70)] \leq 50$. If the loss elastic modulus is within the above range, the loss elastic modulus of the toner changes gently with respect to the temperature, and it is possible to keep the low-temperature fixation performance, and to obtain the toner that is excellent in hot-offset resistance. The value [G" (Ta+30)/G" (Ta+70)] is preferably 0.05 to 50, more preferably 0.1 to 40, particularly preferably 0.5 to 30.

The viscoelastic properties of the toner can be arbitrarily controlled by adjusting the ratio of the crystalline resin and amorphous resin in the binder resin, the molecular weight of the resin, and the monomer composition, or performing any other operation.

The average circularity of the toner is not specifically restricted. The average circularity can be appropriately selected depending on the intended purpose. The average circularity is preferably 0.960 to 0.975.

The average circularity of the toner is defined as follows: Average circularity X=(Perimeter of a circle with the same area of a particle projected area/Perimeter of a particle projected image)×100%. The average circularity can be measured in the following manner.

That is, the measurement takes place with a flow-type particle image analyzer ("FPIA-2100"; manufactured by Sysmex Corporation), and the average circularity can be measured by analysis software (FPIA-2100 Data Processing Program for FPIA Version 00-10).

[Production Method of Toner]

The toner of the present invention includes at least a binder resin, a colorant, and an organically-modified layered inorganic mineral. In the toner, the binder resin contains 50% by mass or more of a crystalline resin relative to the binder resin, and the binder resin contains 50% by mass or more of a crystalline resin relative to the binder resin, and the crystalline resin contains a resin having a sulfonic acid group. As for the production method thereof and materials, all publicly known production methods and materials are available as long as conditions are satisfied. Although not specifically limited, for example, the following are available: a kneading pulverization method; and a so-called chemical method, by which toner particles are granulated in an aqueous medium. According to the chemical method, the crystalline resin can be easily granulated. The chemical method is preferred because the organically-modified layered inorganic mineral can be easily disposed in the vicinity of the surface layer of the toner.

As for the chemical method by which toner particles are granulated in the aqueous medium, for example, the following are available among other things: a suspension polymerization method by which production takes place with a monomer as starting material, an emulsion polymerization method, a seed polymerization method, a dispersion polymerization method, and the like; a dissolution suspension method by which a resin or resin precursor is dissolved in an organic solvent or the like, and dispersed or emulsified in an aqueous medium; a phase inversion emulsification method by which water is added to a solution made from a resin or resin precursor and an appropriate emulsifier to cause phase inversion; and a condensation method by which resin particles obtained by the above methods are agglutinated when being dispersed in an aqueous medium, and are granulated by heating and melting, or the like, into particles of a desired size. Among the above, the toner obtained by the dissolution suspension method is more preferred in terms of granulation performance by crystalline resin (easy control of particle size distribution, control of particle shape, and the like), and the orientation of the organically-modified layered inorganic mineral in the vicinity of the surface layer of the toner.

The following describes the above production methods in detail.

For example, the kneading pulverization method is a method of pulverizing and classifying those made by melt-kneading toner materials, which at least include a colorant, a binder resin, and a layered inorganic mineral, to produce base particles of the toner.

During the melt-kneading process, the toner materials are mixed together, and the mixture is put into a melt kneader and melt-kneaded. Examples of the melt kneader, for example, the following are available among other things: a uniaxial or biaxial continuous kneader, and a batch kneader with a roll mill. Among such melt kneaders, the following are preferred among other things: a KTK-type twin-screw extruder manufactured by Kobe Steel, Ltd.; a TME-type extruder manufactured by TOSHIBA MACHINE CO., LTD.; a twin-screw extruder manufactured by KCK Co., Ltd.; a PCM-type twin-screw extruder manufactured by Ikegai Corp; and a co-kneader manufactured by Buss Co. The melt-kneading is preferably carried out under appropriate conditions in such a way as not to cut the molecular chain of the binder resin. More specifically, the melt-kneading temperature is determined based on the softening point of the binder resin. If the temperature is far higher than the softening point, the molecular chain is cut significantly. If the temperature is too low, the dispersion may not progress.

During the pulverization process, the kneaded product, which is obtained by the kneading, is pulverized. In the pulverization process, it is preferred that first the kneaded product be coarsely pulverized before being finely pulverized. At this time, the following methods are preferably used: a method of pulverizing by crashing the product against a collision plate in a jet stream; a method of pulverizing by crashing particles against one another in a jet stream; and a method of pulverizing in a narrow gap between a mechanically rotating rotor and a stator.

During the classification process, the pulverized product, which is obtained by the pulverization, is classified and adjusted so that particles of a predetermined diameter are obtained. The classification can be carried out by removing fine-particle components with the use of a cyclone, decanter, centrifuge, or the like, for example.

After the pulverization and the classification are completed, the pulverized product is classified by centrifugal force or the like into an air flow, and toner base particles of a predetermined particle diameter can be produced.

The chemical method is not specifically restricted. The chemical method can be appropriately selected depending on the intended purpose. However, the following method is preferred: a method of dispersing or emulsifying the toner materials, which at least include the binder resin, the colorant, and the organically-modified layered inorganic mineral, in an aqueous medium to granulate base particles of the toner. As for the toner of the present invention, the following toner is preferred: a toner that is obtained by dispersing or emulsifying fine particles, which at least include the binder resin, the colorant, and the organically-modified layered inorganic mineral, in an aqueous medium, and thereby granulating toner particles.

As for the chemical method, the following method is preferred: a method of dispersing or emulsifying, in an aqueous medium, an oil phase that is made by dissolving or dispersing, in an organic solvent, toner materials, which at least include the binder resin or the binder resin precursor, and the colorant, and the organically-modified layered inorganic mineral.; and thereby granulating base particles of the toner. As for the toner of the present invention, the following toner is preferred: a toner that is obtained by dispersing or emulsifying, in an aqueous medium, an oil phase that is made by dissolving or dispersing, in an organic solvent, toner materials, which at least include the binder resin or the binder resin precursor, and the colorant, and the organically-modified layered inorganic mineral; and thereby granulating toner particles.

The crystalline resin is excellent in impact resistance, and therefore is not suited for the pulverization method in terms of energy efficiency. It is also difficult for the organically-modified layered inorganic mineral to be disposed in the vicinity of the surface layer of the toner. According to the chemical methods such as the dissolution suspension method and the ester extension method, the crystalline resin can be easily granulated. The chemical methods are preferred because the organically-modified layered inorganic mineral is disposed evenly in the vicinity of the surface layer of the toner at the time of dispersion or emulsification in an aqueous medium.

For emulsification or dispersion in an aqueous medium, a surfactant, a polymeric protective colloid, or the like may be used when necessary.

—Surfactant—

The surfactant is not specifically restricted. The surfactant can be appropriately selected depending on the intended purpose. For example, the following are available among other things: anionic surfactants, such as alkyl benzene sulfonate, α-olefin sulfonate, and phosphate ester; cationic surfactants of a amine salt type, such as alkyl amine salt, amino alcohol fatty acid derivatives, polyamine fatty acid derivatives, and imidazoline, and cationic surfactants of a quaternary ammonium salt type, such as alkyl trimethyl ammonium salt, dialkyl dimethyl ammonium salt, alkyl dimethyl benzyl ammonium salt, pyridinium salt, alkyl isoquinolinium salt, and benzethonium chloride; non-ionic surfactants, such as fatty acid amide derivatives, and polyhydric alcohol derivatives; amphoteric surfactants, such as alanine, dodecyldi (aminoethyl)glycine, di(octylaminoethyl)glycine, and N-alkyl-N,N-dimethyl ammonium betaine.

—Organic Solvent—

As for the organic solvent that is used to dissolve or disperse toner materials that contain the binder resin or the binder resin precursor, and the colorant and the organically-modified layered inorganic mineral, the following solvent is preferred in terms of how easy it is to later remove the solvent: a volatile solvent whose boiling point is less than 100° C.

Examples of the organic solvent, for example, the following are available among other things: toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. One of the above substances may be used independently, or two or more of the above substances may be used in combination. Among the above substances, the following are preferred: ester solvents, such as methyl acetate and ethyl acetate, aromatic solvents, such as toluene and xylene, halogenated hydrocarbons, such as methylene chloride, 1,2-dichloroethane, chloroform, and carbon tetrachloride.

The solid concentration of the oil phase, which is obtained by dissolving or dispersing toner materials containing the binder resin or the binder resin precursor, and the colorant and the organically-modified layered inorganic mineral, is preferably 40% by mass to 80% by mass. If the solid concentration is too high, it becomes difficult to dissolve or disperse, and it also becomes difficult to handle because of high viscosity. If the solid concentration is too low, the amount of toner produced becomes smaller.

The following may be individually dissolved or dispersed in the organic solvent, and be mixed in with the resin dissolution liquid or the dispersion liquid: the toner materials except the resin, such as the colorant and the organically-modified layered inorganic mineral; and the masterbatches of the above.

—Aqueous Medium—

The aqueous medium may be only made of water. A solvent that can be mixed with water may also be used. Examples of the solvent that can be mixed with water, for example, the following are available among other things: alcohol (methanol, isopropanol, ethylene glycol, and the like), dimethylformamide, tetrahydrofuran, cellosolves (methyl cellosolve, and the like), and lower ketones (acetone, methyl ethyl ketone, and the like).

The amount of the aqueous medium used relative to 100 parts by mass of the toner materials is not specifically restricted. The amount can be appropriately selected depending on the intended purpose. The amount is usually 50 parts by mass to 2,000 parts by mass, preferably 100 to 1,000 parts by mass. If the amount used is less than 50 parts by mass, the dispersion state of the toner materials is not good, and toner particles of a predetermined particle size cannot be obtained. If the amount used is greater than 2,000 parts by mass, the amount is not economically viable.

In the aqueous medium, an inorganic dispersant, or organic resin fine particles, may be dispersed in advance in the aqueous medium. In this case, the particle size distribution becomes sharp. The dispersion of an inorganic dispersant, or organic resin fine particles, is preferred in terms of dispersion stability.

Examples of the inorganic dispersant, for example, the following are available among other things: tricalcium phosphate, calcium carbonate, titanium oxide, colloidal silica, and hydroxyapatite.

Examples of a resin that forms the organic resin fine particles, any kind of resin is available as long as the resin is able to form aqueous dispersing elements. The resin may be either a thermoplastic resin or a thermosetting resin. For example, the following are available among other things: vinyl resin, polyurethane resin, epoxy resin, polyester resin, polyamide resin, polyimide resin, silicon resin, phenolic resin, melamine resin, urea resin, aniline resin, ionomer resin, and polycarbonate resin. One of the above resins may be used independently, or two or more of the above resins may be used in combination. Among the above resins, in terms of how easy it is to obtain aqueous dispersing elements of fine spherical resin particles, the following are preferred: vinyl resin, polyurethane resin, epoxy resin, polyester resin, and the combination of the above resins.

A method of emulsification or dispersion in an aqueous medium is not specifically restricted. However, publicly known equipment, including the following, are available: low-speed shearing type, high-speed shearing type, friction type, high-pressure jet type, and ultrasonic. Among the above, in terms of making the diameter of particles smaller, a high-speed shearing type is preferred. When a high-speed shearing type disperser is used, the rotational speed is not particularly limited. However, the rotational speed is usually 1,000 rpm to 30,000 rpm, preferably 5,000 rpm to 20,000 rpm. The temperature at the time of dispersion is usually 0° C. to 150° C. (under pressure), preferably 20° C. to 80° C.

If the toner materials include the binder resin precursor, the following may be mixed in the oil phase in advance before the dispersion of the toner materials takes place in the aqueous medium, or may be mixed in the aqueous medium: a compound having the active hydrogen groups necessary for the extension or cross-linking reaction of the binder resin precursor, and the like.

In order to remove the organic solvent from the obtained emulsification dispersing elements, a publicly known method is available. For example, the following method can be employed: a method of gradually increasing the temperature of the entire system under normal pressure or reduced pressure, and completely evaporating and removing the organic solvent in droplets.

If the aggregation method is used in the aqueous medium, the following are mixed and agglutinated together for granulation: the resin fine particle dispersion liquid that is obtained by the above method, the colorant dispersion liquid, the organically-modified layered inorganic mineral dispersion liquid, and, if necessary, the dispersion liquid such as the release agent. As for the type of the resin fine particle dispersion liquid, one type may be used independently, or two or more types of the resin fine particle dispersion liquid may be added. The resin fine particle dispersion liquid may be added at once, or in several stages. The same is true for the other dispersion liquids.

In order to control the aggregation state, the following methods are preferably used among other things: a method of adding heat; a method of adding metal salts; and a method of adjusting pH.

The metal salts are not specifically restricted. The metal salts can be appropriately selected depending on the intended purpose. For example, the following are available among other things: monovalent metals that constitute salts, such as sodium and potassium; divalent metals that constitute salts, such as calcium and magnesium; trivalent metals that constitute salts, such as aluminum.

Examples of the anions that constitute the salts, for example, the following are available among other things: chloride ions, bromide ions, iodide ions, carbonate ions, and sulfate ions. Among the above substances, the following are preferred: magnesium chloride, aluminum chloride, and complexes or multimeric complexes thereof.

A process of heating in the middle of the aggregation process or after the aggregation process is preferred in terms of uniformity of the toner as the fusion of the resin fine particles can be promoted. Furthermore, the heating process makes it possible to control the shape of the toner. As the toner is heated even more, the toner usually becomes more spherical.

For a process of cleaning and drying base particles of the toner that are dispersed in the aqueous medium, publicly known techniques are used.

That is, after solid-liquid separation is carried out by a centrifuge, filter press, or the like, a toner cake obtained is dispersed again in ion-exchanged water that is from a normal temperature to about 40° C. After the pH is adjusted with acid or alkali if necessary, solid-liquid separation is carried out again. Such a process is repeated several times to remove impurities, surfactants, and the like. Then, a drying process is carried out with a flash dryer, a circulation dryer, a vacuum dryer, a vibration flow dryer, or the like to obtain toner powder. At this time, the fine particle components of the toner may be removed by centrifugation or the like. After the drying process, a publicly known classifier may be used, if necessary, to obtain a desired particle size distribution.

The obtained dried toner powder may be mixed with different kinds of particles, such as the charge-control fine particles and fluidizer fine particles; or mechanical impact may be given to the obtained mixed powder. As a result, immobilization and fusion would take place on the surface. Therefore, it is possible to prevent different kinds of particles from coming off from the surface of the obtained composite particles.

As for specific methods, for example, the following are available among other things: a method of adding a shock to the mixture with the use of blades that rotate at high speed; and a method of putting the mixture into a high-speed airflow, accelerating the airflow, and crashing particles against each other or crashing composite particles against an appropriate collision plate.

For example, the devices used for the above methods include ANGMILL (manufactured by Hosokawa Micron Group); a device that is made by recreating an I-type mill (manufactured by Nippon Pneumatic Mfg. Co., Ltd.) in a way that lowers the pulverization air pressure; HYBRIDIZATION SYSTEM (manufactured by Nara Machinery Co., Ltd.); CRIPTRON SYSTEM (manufactured by Kawasaki Heavy Industries, Ltd.); and an automatic mortar.

(Developer)

The developer of the present invention contains the toner. The developer may further contain a carrier or any other component, which is appropriately selected when necessary.

The developer may be one-component developer or two-component developer. However, the two-component developer is preferred in terms of improving life and other factors if the developer is used for a high-speed printer or the like that keeps up with recent improvements in information processing speed.

In the case of the one-component developer that uses the toner, the balance of toner, that is, even if the supply of the toner to the developer, and the consumption of the toner by developing are carried out, a change in the particle diameter of the toner is small. The filming of the toner onto the developing roller, and the fusion of the toner onto a layer thickness regulating member, such as a blade that is used to turn the toner into a thin layer, do not occur. Even when the developing unit is used for a long period of time (stirring), an excellent and stable development performance, and image are obtained.

In the case of the two-component developer that uses the toner, even in the long-term balance of toner, a change in the particle diameter of the toner in the developer is small. Even in the long-term stirring by the developing unit, an excellent and stable development performance can be obtained.

<Carrier>

The carrier is not specifically restricted. The carrier can be appropriately selected depending on the intended purpose. A carrier that has a core material and a resin layer that covers the core material is preferred.

The core material is not specifically restricted. The core material can be appropriately selected from those publicly known. The following are preferred among other things: a manganese-strontium (Mn—Sr)-based material of 50 emu/g to 90 emu/g; and a manganese-magnesium (Mn—Mg)-based material of 50 emu/g to 90 emu/g. In terms of ensuring the image density, the following are preferred: high magnetization materials, such as iron powder (100 emu/g or more), and magnetite (75 emu/g to 120 emu/g). In terms of being able to weaken the impact on the electrostatic latent image bearing member where toner stands like wheat-ears, as well as of being advantageous for increasing the quality of the image, the following are preferred: weak magnetization materials such as copper-zinc (Cu—Zn)-based material (30 emu/g to 80 emu/g). One of the above substances may be used independently, or two or more of the above substances may be used in combination.

Measured in average particle diameter (weight average particle diameter (D50)), the particle diameter of the core material is preferably 10 μm to 200 μm, more preferably 40 μm to 100 μm. If the average particle diameter (weight average particle diameter (D50)) is less than 10 μm, fine particles increase in the carrier particle distribution. As a result, magnetization per particle is decreased, possibly causing spreading of carriers. If the average particle diameter is greater than 200 μm, there may be a decrease in the specific surface area, possibly causing spreading of carriers. In full color with many solid parts, the reproducibility of the solid parts may be particularly bad.

The material of the resin layer is not specifically restricted. The material of the resin layer can be appropriately selected from among publicly known resins depending on the intended purpose. For example, the following are available among other things: amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoro-terpolymer (fluorinated triple (multiple) copolymer) such as terpolymer of tetrafluoroethylene, vinylidene fluoride, and non-fluorinated monomer, and silicone resin. One of the above substances may be used independently, or two or more of the above substances may be used in combination. Among the above substances, silicone resin is particularly preferred.

The silicone resin is not specifically restricted. The silicone resin can be appropriately selected from among generally-known silicone resins depending on the intended purpose. For example, the following are available among other things: straight silicone resin that is made only of organosiloxane bonds; and silicone resin that is modified with alkyd resin, polyester resin, epoxy resin, acrylic resin, urethane resin, or the like.

Examples of the silicone resin, commercialized products are available. For example, examples of the straight silicone resin, the following are available among other things: KR271, KR255, and KR152 manufactured by Shin-Etsu Chemical Co., Ltd.; SR2400, SR2406, and SR2410 manufactured by Dow Corning Toray Silicone Co., Ltd.

As for the modified silicone resin, commercialized products are available. For example, the following are available among other things: KR206 (Alkyd modified), KR5208 (Acrylic modified), ES1001N (Epoxy modified), and KR305 (Urethane modified) manufactured by Shin-Etsu Chemical Co., Ltd.; and SR2115 (Epoxy modified) and SR2110 (Alkyd modified) manufactured by Dow Corning Toray Silicone Co., Ltd.

The silicone resin may be used alone, or the silicone resin may be used together with components for cross-linking reaction, amount-of-charge adjustment components, and the like.

To the resin layer, conductive powder or the like may be added if necessary. Examples of the conductive powder, for example, the following are available among other things: metal powder, carbon black, titanium oxide, tin oxide, and zinc oxide. The average particle diameter of the conductive powder is preferably 1 μm or less. If the average particle diameter is greater than 1 μm, it may be difficult to control the electrical resistance.

For example, the resin layer can be formed in the following manner: the silicone resin or the like is dissolved in a solvent to prepare a coating solution, and the coating solution is evenly applied by a publicly known coating method to the surface of the core material and is dried and baked. As for the coating method, for example, the following are available among other things: a dipping method, a spraying method, and a brush coating method.

The solvent is not specifically restricted. The solvent can be appropriately selected depending on the intended purpose. For example, the following are available among other things: toluene, xylene, methyl ethyl ketone, methyl isobutyl ketone, cellosolve, and butyl acetate.

The baking method is not specifically restricted. The baking method may be an external heating method or an internal heating method. For example, the following are available among other things: a method of using a fixed-type electric furnace, a fluid-type electric furnace, a rotary-type electric furnace, or a burner furnace; and a method of using a microwave.

In general, the mixing ratio of the two-component developer toner and the carrier is preferably as follows: Relative to 100 parts by mass of the carrier, 1 part by mass to 10.0 parts by mass of the toner.

(Image Forming Apparatus)

The image forming apparatus of the present invention includes at least an electrostatic latent image bearing member, charging unit, exposing unit, developing unit, transfer unit, and fixing unit. The image forming apparatus may further include other units, which are appropriately selected if necessary, such as cleaning unit, discharging device, recycling unit, and control unit.

The developing unit is a unit configured to develop the electrostatic latent image with a toner to form a visible image. The toner is the toner of the present invention.

Incidentally, the charging unit and the exposing unit may be collectively referred to as electrostatic latent image formation unit. The developing unit includes magnetic field generation unit that is fixed to the inside, and a developer bearing member that can bear the toner of the present invention and rotate.

<Electrostatic Latent Image Bearing Member>

The electrostatic latent image bearing member is not specifically restricted in terms of material, shape, structure, size, and other factors. The electrostatic latent image bearing member can be appropriately selected depending on the intended purpose. As for the shape, for example, the following are available among other things: a drum type, a sheet type, and an endless belt type. As for the structure, the following are available: a single-layer structure, and a laminated structure. The size can be appropriately selected according to the size and specifications of the image forming apparatus and other factors. Examples of the material, for example, the following are available among other things: inorganic photoconductors, such as amorphous silicon, selenium, CdS, and ZnO; organic photoconductors (OPC), such as polysilane and phthalopolymethine.

<Charging Unit>

The charging unit is a unit configured to charge the surface of the electrostatic latent image bearing member.

The charging unit is not specifically restricted as long as the surface of the electrostatic latent image bearing member is evenly charged by voltage applied. The charging unit can be appropriately selected depending on the intended purpose. The charging unit are broadly classified into the following two: (1) charging unit of a contact type, which is designed to come in contact with the electrostatic latent image bearing member to charge; and (2) charging unit of a non-contact type, which is designed to charge the electrostatic latent image bearing member without coming in contact with the electrostatic latent image bearing member.

As for the contact-type charging unit of the above section (1), for example, the following are available among other things: conductive or semi-conductive charging roller, magnetic brush, fur brush, film, and rubber blade. Among the above, the charging roller is able to significantly reduce the amount of ozone generated compared with corona discharge, is excellent in stability at a time when the electrostatic latent image bearing member is repeatedly used, and is effective in preventing deterioration in the quality of the image.

As for the non-contact-type charging unit of the above section (2), for example, the following are available among other things: a non-contact charging unit that uses corona discharge, a needle-electrode device, and a solid discharge element; and a conductive or semi-conductive charging roller, which is disposed on the electrostatic latent image bearing member with a small gap therebetween.

<Exposing Unit>

The exposing unit is a unit configured to expose the surface charged of the electrostatic latent image bearing member to light to form an electrostatic latent image.

The exposing unit is not specifically restricted as long as the surface of the electrostatic latent image bearing member, which is charged by the charging unit, can be exposed to light in such a way as to have an image pattern that should be formed. The exposing unit can be appropriately selected depending on the intended purpose. For example, the following are available among other things: various exposing units, such as a copying optical system, a rod lens array system, a laser optical system, a liquid crystal shutter optical system, and a LED optical system. The following may be employed: a back light system in which the back surface of the electrostatic latent image bearing member is so exposed as to have an image pattern.

<Developing Unit>

The developing unit is a unit configured to develop the electrostatic latent image with a toner to form a visible image. The toner is the toner of the present invention.

For example, the developing unit is not specifically restricted as long as it is possible to develop with the toner. The developing unit can be appropriately selected from among those publicly known depending on the intended purpose. For example, the following are preferred: those equipped at least with developing unit that is able to store the toner and add the toner to the electrostatic latent image in a contact or non-contact manner.

The developing unit may be of a dry developing type or a wet developing type. The developing unit may be a single-color developing unit or a multiple-color developing unit. For example, the following is preferred among other things: a developing device that has a stirrer, which is designed to charge the toner through friction and stirring, and a magnetic field generation unit, which is fixed to the inside, and also includes a developer bearing member, which bears the developer containing the toner on the surface and can rotate.

In the developing unit, for example, the toner and the carrier are mixed and stirred. The toner is charged by friction at that time. The toner is kept on a surface of a rotating magnet roller as if ears of wheat stand. In this manner, a magnetic brush is formed. The magnet roller is disposed near the electrostatic latent image bearing member. Therefore, part of the toner that constitutes the magnetic brush formed on the surface of the magnet roller moves to the surface of the electrostatic latent image bearing member due to an electrical attraction force. As a result, the electrostatic latent image is developed by the toner. A visible image is formed by the toner on the surface of the electrostatic latent image bearing member.

FIG. 1 is a schematic diagram showing one example of a two-component developing device that uses a two-component developer made up of a toner and a magnetic carrier. In the two-component developing device shown in FIG. 1, the two-component developer is stirred and conveyed by a screw agitator 441, and is supplied to a developing sleeve 442, which serves as a developer bearing member. The two-component developer that is supplied to the developing sleeve 442 is controlled by a doctor blade 443, which serves as a layer thickness regulating member. The amount of developer supplied is controlled based on a doctor gap, or a gap between the doctor blade 443 and the developing sleeve 442. If the doctor gap is too small, the amount of developer is too small, resulting in insufficient image density. If the doctor gap is too large, the amount of developer supplied is too much, and the problem arises that the carrier adheres to a photosensitive drum 1, which serves as an electrostatic latent image bearing member. In the developing sleeve 442, magnets are provided as magnetic field generation unit to form a magnetic field in such a way as to make the developer stand like wheat-ears on a circumferential surface thereof. Along the normal-direction magnetic field lines generated from the magnets, the developer stands up in a chain pattern on the developing sleeve 442 as if wheat-ears stand, thereby forming a magnetic brush.

The developing sleeve 442 and the photosensitive drum 1 are disposed adjacent to each other, with a constant gap (development gap) therebetween. On the facing portions of both, developing areas are formed. The developing sleeve 442 is made by forming a nonmagnetic material, such as aluminum, brass, stainless, and conductive resin, into a cylindrical shape. The developing sleeve 442 is rotated by a rotation driving mechanism (not shown). The magnetic brush is transferred to the developing areas by rotation of the developing sleeve 442. To the developing sleeve 442, a development voltage is applied from a development power source (not shown). The toner that exists on the magnetic brush is separated from the carrier by a development field, which is formed between the developing sleeve 442 and the photosensitive drum 1, which serves as an electrostatic latent image bearing member. As a result, an image is developed on the electrostatic latent image on the photosensitive drum 1. Incidentally, alternate current may be superimposed on the development voltage.

The development gap is preferably about five to thirty times as large as the particle diameter of the developer. If the particle diameter of the developer is 50 μm, the development gap is preferably set to 0.25 mm to 1.5 mm. If the development gap is further increased, it may be difficult to achieve a desired image density.

The doctor gap is preferably equal in size to, or slightly larger than, the development gap. The drum diameter and drum linear speed of the photosensitive drum 1, and the sleeve diameter and sleeve linear speed of the developing sleeve 442 are determined based on constraints such as the copying speed and the size of the device. In order to obtain a required image density, the ratio of the sleeve linear speed to the drum linear speed is preferably greater than or equal to 1.1. Incidentally, a sensor may be placed at a post-development position to detect the amount of toner that adheres thereto from optical reflectance, and the process conditions may be controlled.

<Transfer Unit>

The transfer unit is a unit configured to transfer the visible image to a recording medium.

The transfer unit is broadly classified into the following: transfer unit configured to transfer the visible image on the electrostatic latent image bearing member directly to a recording medium; and secondary transfer unit that uses an intermediate transfer member, in which case the visible image is first transferred to the intermediate transfer member before being transferred to the recording medium. Any transfer unit is not specifically restricted. The transfer unit can be appropriately selected from among publicly known transfer members depending on the intended purpose.

<Fixing Unit>

The fixing unit is a unit configured to fix a transfer image that is transferred onto the recording medium.

The fixing unit is not specifically restricted. The fixing unit can be appropriately selected depending on the intended purpose. The following is preferred: a fixing device that includes fixing members and a heat source that heats the fixing members. The fixing members are not specifically restricted as long as the fixing members can come in contact with each other to form a nip portion. The fixing members can be appropriately selected depending on the intended purpose. For example, the following are available among other things: a combination of an endless belt and a roller, and a combination of a roller and a roller. In terms of being able to shorten warm-up time, as well as of energy saving, the following is preferably used: a method of heating from surfaces of the fixing members by means of a combination of an endless belt and a roller or induction heating.

The fixing unit is broadly classified into the following: (1) a mode (internal heating type) in which the fixing unit includes at least a roller or belt, the heating starts from a surface that is not in contact with the toner, and the transfer image that is transferred to the recording medium is fixed by heating and pressurization; and (2) a mode (external heating type) in which the fixing unit includes at least a roller or belt, the heating starts from a surface that is in contact with the toner, and the transfer image that is transferred to the recording medium is fixed by heating and pressurization. Incidentally, both modes may be used in combination.

As for the internal heating-type fixing unit of the above section (1), for example, the following are available among other things: a fixing unit in which the fixing members themselves contain heating unit. As for the heating unit, for example, the following are available among other things: heat sources, such as a heater and a halogen lamp.

As for the external heating-type fixing unit of the above section (2), for example, the following type is preferred: at least a portion of a surface of at least one of the fixing members is heated by heating unit. The heating unit is not specifically restricted. The heating unit can be appropriately selected depending on the intended purpose. For example, the following is available among other things: an electromagnetic induction heating unit. The electromagnetic induction heating unit is not specifically restricted. The electromagnetic induction heating unit can be appropriately selected depending on the intended purpose. However, the following is preferred among other things: the electromagnetic induction heating unit that includes a unit configured to generate a magnetic field, and a unit configured to generate heat with the help of electromagnetic induction. As for the electromagnetic induction heating unit, for example, the following is preferred: the electromagnetic induction heating unit that includes an induction coil that is so disposed as to be close to the fixing members (e.g. heating rollers), a shielding layer on which the induction coil is provided, and an insulation layer that is provided on a side opposite to a surface where the induction coil of the shielding layer is provided. At this time, as for the heating roller, the following are preferred among other things: a heating roller of a type that is made from a magnetic material, and a heating roller of a type that is a heat pipe. It is preferred that the induction coil be so disposed as to wrap at least a semi-cylindrical portion of the heating roller on a side opposite to a contact site where the heating roller is in contact with the fixing members (e.g. a pressure roller, an endless belt, or the like).

(Process Cartridge)

The process cartridge of the present invention at least includes an electrostatic latent image bearing member and developing unit. The process cartridge may further include other units, which are appropriately selected when necessary, such as charging unit, exposing unit, transfer unit, cleaning unit, and discharging unit.

The developing unit is a unit configured to develop an electrostatic latent image, which is born by the electrostatic latent image bearing member, with a toner to form a visible image. The toner is required to be the toner of the present invention.

The developing unit includes at least a toner storage unit that stores the toner, and a toner bearing member that bears the toner stored in the toner storage unit and conveys the toner. The developing unit may further include a layer thickness regulating member that regulates the thickness of the toner layer born, and the like. The developing unit preferably includes at least a developer storage unit that stores the two-component developer, and a developer bearing member that bears the two-component developer stored in the developer storage unit and conveys the two-component developer. More specifically, one of the developing unit that have been described in explaining the image forming apparatus is preferably used.

As for the charging unit, the exposing unit, the transfer unit, the cleaning unit, and the discharging unit, the same components as those of the above-described image forming apparatus can be appropriately selected for use.

The process cartridge can be mounted on image forming apparatus of various electrophotographic types, fax machines, and printers in such a way that the process cartridge can be attached thereto or removed therefrom. It is particularly preferred that the process cartridge be mounted on the image forming apparatus of the present invention in such a way that the process cartridge can be attached thereto or removed therefrom.

Figure 2:
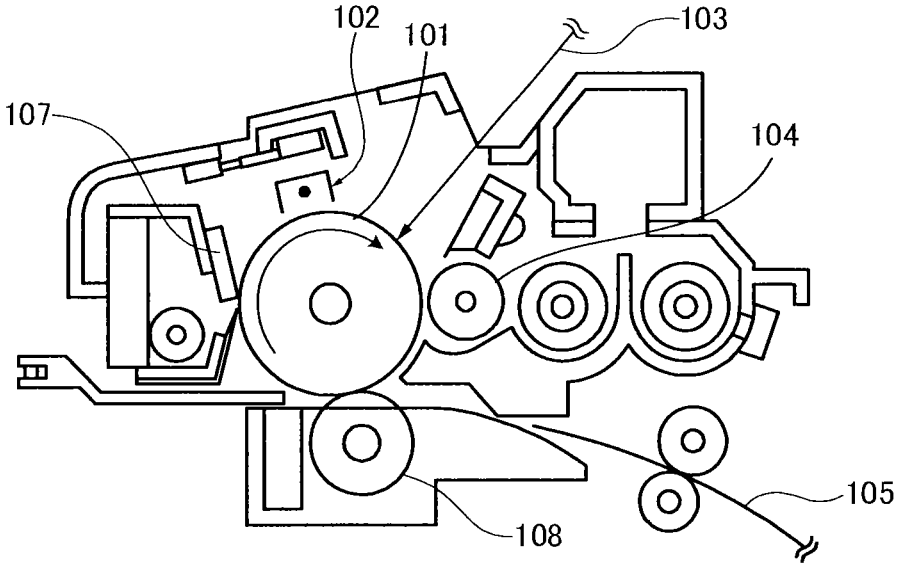
FIG. 2 is a schematic diagram showing one example of a process cartridge of the present invention.

For example, as shown in FIG. 2, the process cartridge includes a built-in electrostatic latent image bearing member 101, and also includes charging unit 102, developing unit 104, transfer unit 108, and cleaning unit 107. The process cartridge may further include other units if necessary. In FIG. 2, reference numeral 103 represents exposure by exposing unit; reference numeral 105 represents a recording medium.

The following describes an image formation process by the process cartridge shown in FIG. 2. The electrostatic latent image bearing member 101 rotates in a direction indicated by arrow. On the surface of the electrostatic latent image bearing member 101, an electrostatic latent image corresponding to an exposure image is formed by charging of the charging unit 102 and exposure 103 of the exposing unit (not shown). The electrostatic latent image is developed with the toner by the developing unit 104. The developed toner image is transferred by the transfer unit 108 to the recording medium 105 and is then printed out. Then, after the image is transferred, the surface of the electrostatic latent image bearing member is cleaned by the cleaning unit 107, and is then discharged by the discharging unit (not shown). The above operation is repeated.

EXAMPLES

The following describes in more detail the present invention on the basis of examples. However, the present invention is not limited to the examples described below. The unit "part" means "parts by mass" unless otherwise specified. The unit "%" means "% by mass" unless otherwise specified.

Production Example 1

Production of Crystalline Resin A1

In a reaction vessel that was equipped with a cooling tube, a stirrer, and a nitrogen inlet tube, the following were put: 241 parts of sebacic acid, 27 parts of adipic acid, 164 parts of 1,4-butanediol, 10 parts of 5-sulfoisophthalic acid sodium, and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,4-butanediol were distilled off. Furthermore, under reduced pressure of 5 mmHg to 20 mmHg, the reaction continued until the weight-average molecular weight (Mw) reached about 6,000. As a result, a crystalline resin intermediate was obtained.

Then, 218 parts of the obtained crystalline resin intermediate was transferred into a reaction vessel that was equipped with a cooling tube, a stirrer, and a nitrogen inlet tube. Then, the following were added: 250 parts of ethyl acetate, and 82 parts of hexamethylene diisocyanate (HDI). Under a nitrogen stream at 80° C., the reaction took place for five hours. Then, under reduced pressure, ethyl acetate was distilled off. As a result, the following was obtained: [Crystalline resin A1] (Urethane-modified polyester resin), Mw: about 22,000.

Production Example 2

Production of Crystalline Resin A2

In a reaction vessel that was equipped with a cooling tube, a stirrer, and a nitrogen inlet tube, the following were put: 275 parts of sebacic acid, 215 parts of 1,6-hexanediol, 10 parts of 5-sulfoisophthalic acid sodium and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 5,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 82 parts of hexamethylene diisocyanate (HDI). Under a nitrogen stream at 80° C., the reaction took place for five hours. Then, under reduced pressure, ethyl acetate was distilled off. As a result, the following was obtained: [Crystalline resin A2] (Urethane-modified polyester resin), Mw: about 20,000.

Production Example 3

Production of Crystalline Resin A3

In a reaction vessel that was equipped with a cooling tube, a stirrer, and a nitrogen inlet tube, the following were put: 313 parts of dodecanedioic acid, 215 parts of 1,6-hexanediol, 10 parts of 5-sulfoisophthalic acid sodium and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 4,500. As a result, a crystalline resin intermediate was obtained.

Then, 269 parts of the obtained crystalline resin intermediate was transferred into a reaction vessel that was equipped with a cooling tube, a stirrer, and a nitrogen inlet tube. Then, the following were added: 250 parts of ethyl acetate, and 85 parts of toluene diisocyanate (TDI). Under a nitrogen stream at 80° C., the reaction took place for five hours. Then, under reduced pressure, ethyl acetate was distilled off. As a result, the following was obtained: [Crystalline resin A3] (Urethane-modified polyester resin), Mw: about 18,000.

Production Example 4

Production of Crystalline Resin A4

In a reaction vessel that was equipped with a cooling tube, a stirrer, and a nitrogen inlet tube, the following were put: 275 parts of sebacic acid, 215 parts of 1,6-hexanediol, 10 parts of 5-sulfoisophthalic acid sodium and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 5,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 120 parts of isophorone diisocyanate (IPDI). Under a nitrogen stream at 80° C., the reaction took place for five hours. Then, under reduced pressure, ethyl acetate was distilled off. As a result, the following was obtained: [Crystalline resin A4] (Urethane-modified polyester resin), Mw: about 19,000.

Production Example 5

Production of Crystalline Resin A5

In a reaction vessel that was equipped with a cooling tube, a stirrer, and a nitrogen inlet tube, the following were put: 275 parts of sebacic acid, 215 parts of 1,6-hexanediol, 10 parts of 5-sulfoisophthalic acid sodium and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 5,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 85 parts of toluene diisocyanate (TDI). Under a nitrogen stream at 80° C., the reaction took place for five hours. Then, under reduced pressure, ethyl acetate was distilled off. As a result, the following was obtained: [Crystalline resin A5] (Urethane-modified polyester resin), Mw: about 19,000.

Production Example 6

Production of Crystalline Resin A6

In a reaction vessel that was equipped with a cooling tube, a stirrer, and a nitrogen inlet tube, the following were put: 259 parts of sebacic acid, 215 parts of 1,6-hexanediol, 30 parts of 5-sulfoisophthalic acid sodium and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 5,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 82 parts of hexamethylene diisocyanate (HDI). Under a nitrogen stream at 80° C., the reaction took place for five hours. Then, under reduced pressure, ethyl acetate was distilled off. As a result, the following was obtained: [Crystalline resin A6] (Urethane-modified polyester resin), Mw: about 20,000.

Production Example 7

Production of Crystalline Resin A7

In a reaction vessel that was equipped with a cooling tube, a stirrer, and a nitrogen inlet tube, the following were put: 267 parts of sebacic acid, 215 parts of 1,6-hexanediol, 20 parts of 5-sulfoisophthalic acid sodium and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 5,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 82 parts of hexamethylene diisocyanate (HDI). Under a nitrogen stream at 80° C., the reaction took place for five hours. Then, under reduced pressure, ethyl acetate was distilled off. As a result, the following was obtained: [Crystalline resin A7] (Urethane-modified polyester resin), Mw: about 20,000.

Production Example 8

Production of Crystalline Resin A8

In a reaction vessel that was equipped with a cooling tube, a stirrer, and a nitrogen inlet tube, the following were put: 283 parts of sebacic acid, 215 parts of 1,6-hexanediol, and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 5,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 82 parts of hexamethylene diisocyanate (HDI). Under a nitrogen stream at 80° C., the reaction took place for five hours. Then, under reduced pressure, ethyl acetate was distilled off. As a result, the following was obtained: [Crystalline resin A8] (Urethane-modified polyester resin), Mw: about 20,000.

Production Example 9

Production of Crystalline Resin A9

In a reaction vessel that was equipped with a cooling tube, a stirrer, and a nitrogen inlet tube, the following were put: 243 parts of sebacic acid, 215 parts of 1,6-hexanediol, 45 parts of 5-sulfoisophthalic acid sodium and 0.75 parts of titanium dihydroxy bis(triethanolaminate) as a condensation catalyst. Under a nitrogen stream at 180° C., the reaction took place for eight hours as the generated water was distilled off. Then, the temperature was gradually raised to 225° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 5,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 82 parts of hexamethylene diisocyanate (HDI). Under a nitrogen stream at 80° C., the reaction took place for five hours. Then, under reduced pressure, ethyl acetate was distilled off. As a result, the following was obtained: [Crystalline resin A9] (Urethane-modified polyester resin), Mw: about 20,000.

As to whether the resins obtained in Production Examples 1 to 9 were crystalline or amorphous resins, the ratio (Softening temperature (Tb)/Heat-of-fusion maximum peak temperature (Ta)) of the softening temperature (Tb), which was measured by a high load-type flow tester, and the heat-of-fusion maximum peak temperature (Melting point, Ta), which was measured by a differential scanning calorimeter (DSC), was calculated. If the ratio was 0.80 to 1.55, it was determined that the resin was "crystalline resin." If the ratio was greater than 1.55, it was determined that the resin was "amorphous resin." As a result, as for the resins that were obtained in Production Examples 1 to 9, the ratios were 0.80 to 1.55, and all the resins were crystalline resins.

Table 1 shows the compositions and weight-average molecular weights of the resins produced in Production Examples 1 to 9. The measurement was carried out in accordance with the above-described method.

TABLE 1

| | | Production Examples | | | | | | | | |
|---|---|---|---|---|---|---|---|---|---|---|
| | | 1 | 2 | 3 | 4 | 5 | 6 | 7 | 8 | 9 |
| | Crystalline resin | A1 | A2 | A3 | A4 | A5 | A6 | A7 | A8 | A9 |
| Crystalline resin intermediate | Sebacic acid | 241 | 275 | — | 275 | 275 | 259 | 267 | 283 | 243 |
| | Adipic acid | 27 | — | — | — | — | — | — | — | — |
| | Dodecanedioic acid | — | — | 313 | — | — | — | — | — | — |
| | 1,4-Butanediol | 164 | — | — | — | — | — | — | — | — |
| | 1,6-Hexanediol | — | 215 | 215 | 215 | 215 | 215 | 215 | 215 | 215 |
| | 5-sulfoisophthalic acid sodium | 10 | 10 | 10 | 10 | 10 | 30 | 20 | — | 45 |
| | Mw of crystalline resin intermediate | 6,000 | 5,000 | 4,500 | 5,000 | 5,000 | 5,000 | 5,000 | 5,000 | 5,000 |
| Crystalline resin | Crystalline resin intermediate | 218 | 249 | 269 | 249 | 249 | 249 | 249 | 249 | 249 |
| | HDI | 82 | 82 | — | — | — | 82 | 82 | 82 | 82 |
| | TDI | — | — | 85 | — | 85 | — | — | — | — |
| | IPDI | — | — | — | 120 | — | — | — | — | — |
| | Mw | 22,000 | 20,000 | 18,000 | 19,000 | 19,000 | 20,000 | 20,000 | 20,000 | 20,000 |
| | Amount of sulfonic acid group (% by mass) | 0.49 | 0.45 | 0.42 | 0.40 | 0.45 | 1.34 | 0.90 | 0.00 | 2.16 |

In Table 1, the amounts of monomers blended are expressed in parts by mass.

The amount of sulfonic acid group (% by mass) of a resin containing the sulfonic acid group was calculated as follows:

$$I=(80/268)\times(\text{Amount of 5-sulfoisophthalic acid Na blended})/(\text{Amount of crystalline resin intermediate blended})$$

$$\text{Amount of sulfonic acid group(\% by mass)}=I\times(\text{Ratio of crystalline resin intermediate in crystalline resin})\times 100$$

80: Formula weight of sulfonic acid ($SO_3$)

268: Molecular weight of 5-sulfoisophthalic acid Na

The following describes an example of how to calculate the amount of sulfonic acid group of crystalline resin A1.

The amount of 5-sulfoisophthalic acid Na blended: 10

The amount of crystalline resin intermediate blended: 241+27+164+10=442

$$I=(80/268)\times 10/442=0.006754$$

The ratio of crystalline resin intermediate in crystalline resin=218/(218+82)=0.727

The amount of sulfonic acid group of crystalline resin A1 (% by mass)=0.006754×0.727×100=0.49%

Production Example 10

Production of Crystalline Resin B and Crystalline Resin Precursor B1

In a reaction vessel that was equipped with a cooling tube, a stirrer, and a nitrogen inlet tube, the following were put: 283 parts of sebacic acid, 215 parts of 1,6-hexanediol, and 1 part of titanium dihydroxy bis(triethanolaminate) as a condensation catalyst. Under a nitrogen stream at 180° C., the reaction took place for eight hours as the generated water was distilled off. Then, the temperature was gradually raised to 220° C., and the reaction took place for four hours as the water that was generated under the nitrogen stream, and 1,6-hexanediol were distilled off. Furthermore, under reduced pressure of 5 mmHg to 20 mmHg, the reaction continued until Mw reached about 6,000. As a result, a crystalline resin intermediate was obtained.

Then, 249 parts of the obtained crystalline resin intermediate was transferred into a reaction vessel that was equipped with a cooling tube, a stirrer, and a nitrogen inlet tube. Then, the following were added: 250 parts of ethyl acetate, and 82 parts of hexamethylene diisocyanate (HDI). Under a nitrogen stream at 80° C., the reaction took place for five hours. Then, under reduced pressure, ethyl acetate was distilled off. As a result, the following was obtained: [Crystalline resin B], Mw: about 20,000, Melting point: 65° C. The ratio (Softening temperature (Tb)/Heat-of-fusion maximum peak temperature (Ta)) of the obtained [Crystalline resin B] was 0.80 to 1.55.

Into a reaction vessel that was equipped with a cooling tube, a stirrer, and a nitrogen inlet tube, the following were put: 247 parts of hexamethylene diisocyanate (HDI) and 247 parts of ethyl acetate. Furthermore, the following was added: a resin solution that was made by dissolving 249 parts of [Crystalline resin B] in 249 parts of ethyl acetate. Under a nitrogen stream at 80° C., the reaction took place for five hours. As a result, the following was obtained: an ethyl acetate solution, 50% of which [Crystalline resin precursor B1] (Modified polyester resin) having an isocyanate group at a terminal accounts for.

Production Example 11

Production of Amorphous Resin C1

In a reaction vessel that was equipped with a cooling tube, a stirrer, and a nitrogen inlet tube, the following were put: 240 parts of 1,2-propanediol, 226 parts of terephthalic acid, and 0.64 parts of tetrabutoxytitanate as a condensation catalyst. Under a nitrogen stream at 180° C., the reaction took place for eight hours as the generated methanol was distilled off. Then, the temperature was gradually raised to 230° C., and the reaction took place for four hours as the water that was generated under the nitrogen stream, and 1,2-propanediol were distilled off. Furthermore, under reduced pressure of 5 mmHg to 20 mmHg, the reaction took place for one hour, and the temperature was brought down to 180° C. Then, the following were put: 8 parts of trimellitic anhydride, and 0.5 parts of tetrabutoxytitanate. The reaction took place for one hour. Furthermore, under reduced pressure of 5 mmHg to 20 mmHg, the reaction continued until Mw reached about 7,000. As a result, the following was obtained: [Amorphous resin C1] (Amorphous polyester resin), Melting point: 61° C.

Example 1

Production of Toner

—Production of Colorant Masterbatch P1—

The following were well mixed and kneaded by an open-roll-type kneader (KNEADEX/manufactured by Mitsui Mining Co., Ltd.): 100 parts of [Crystalline resin B], 100 parts of cyan pigment (C.I. Pigment blue 15:3), and 30 parts of ion-exchanged water. As for the kneading temperatures, the kneading started at 90° C. Then, the temperature was gradually lowered to 50° C. In this manner, the following was produced: [Colorant masterbatch P1] whose ratio (mass ratio) of resin and pigment was 1:1.

—Production of Organically-Modified Layered Inorganic Mineral Masterbatch F1—

The following were well mixed and kneaded by an open-roll-type kneader (KNEADEX/manufactured by Mitsui Mining Co., Ltd.): 100 parts of [Crystalline resin B], 100 parts of a montmorillonite compound that was modified with quaternary ammonium salts at least partially having benzyl groups (Organically-modified layered inorganic mineral, CLAYTONE APA, manufactured by Southern Clay Products), and 50 parts of ion-exchanged water. As for the kneading temperatures, the kneading started at 90° C. Then, the temperature was gradually lowered to 50° C. In this manner, the following was produced:

[Organically-modified layered inorganic mineral masterbatch F1] whose ratio (mass ratio) of resin and organically-modified layered inorganic mineral was 1:1.

—Production of Wax Dispersion Liquid—

In a reaction vessel that was equipped with a cooling tube, a thermometer, and a stirrer, the following were put: 20 parts of paraffin wax (HNP-9 (Melting point: 75° C.), manufactured by NIPPON SEIRO CO., LTD.), and 80 parts of ethyl acetate. The above substances were sufficiently melted as the substances were heated to 78° C. The substances were then stirred when being cooled down over one hour to 30° C. The substances were then wet-milled by Ultra Visco Mill (manufactured by AIMEX) under the following conditions: Liquid feeding speed: 1.0 kg/hr, Disk peripheral speed: 10 m/sec, Filling volume of 0.5 mm-diameter zirconia beads: 80% by volume, Number of paths: 6. As a result, the following was obtained: [Wax dispersion liquid].

—Synthesis of Organic Fine Particle Emulsion (Fine Particle Dispersion Liquid)—

In a reaction vessel that was equipped with a stirrer and a thermometer, the following were put and stirred for 15 minutes at 400 rpm: 683 parts of water, 11 parts of sodium salt of sulfate ester of methacrylic acid ethylene oxide adduct (ELEMINOL RS-30, manufactured by Sanyo Chemical Industries), 83 parts of styrene, 83 parts of methacrylic acid, 110 parts of acrylic acid n-butyl, and 1 part of ammonium persulfate. As a result, white emulsion was obtained. The emulsion was heated until the temperature in the system reached 75° C., and the reaction took place for five hours. Furthermore, 30 parts of a 1% aqueous solution of ammonium persulfate were added. Then, the aging took place for five hours at 75° C. As a result, the following was obtained: Aqueous dispersion liquid [Fine particle dispersion liquid 1] of vinyl resins (copolymers of sodium salts of styrene/methacrylic acid/acrylic acid n-butyl/sulfate ester of methacrylic acid ethylene oxide adduct). Measured by LA-920 (manufactured by Horiba, Ltd.), the volume average particle diameter of [Fine particle dispersion liquid 1] was 105 nm. Part of [Fine particle dispersion liquid 1] was dried, and a resin component was isolated. Tg of the resin component was 59° C., and the weight-average molecular weight was 150,000.

—Preparation of Aqueous Phase—

The following were mixed and stirred: 990 parts of water, 83 parts of [Fine particle dispersion liquid 1], 37 parts of a 48.5% aqueous solution of sodium dodecyldiphenylether disulfonate (ELEMINOL MON-7, manufactured by Sanyo Chemical Industries), and 90 parts of ethyl acetate. As a result, a milky-white liquid was obtained, and was regarded as [Aqueous phase 1].

—Preparation of Oil Phase—

In a vessel that was equipped with a thermometer and a stirrer, the following were put: 41 parts of [Crystalline resin A1], 40 parts of [Amorphous resin C1], and 81 parts of ethyl acetate. The above substances were sufficiently melted as the substances were heated to a temperature greater than or equal to a melting point of a resin. Then, the following were added: 20 parts of [Wax dispersion liquid], 2 parts of [Organically-modified layered inorganic mineral masterbatch F1], 12 parts of [Colorant masterbatch P1], and 2 parts of ethyl acetate. The substances were then stirred by a TK type homomixer (manufactured by Tokushu Kika Kogyo Co., Ltd.) at 50° C. at 10,000 rpm, and were evenly dissolved and dispersed. As a result, the following was obtained: [Oil phase 1]. Incidentally, in the vessel, the temperature of [Oil phase 1] was kept at 50° C., and [Oil phase 1] was used within five hours of production so that [Oil phase 1] was not crystallized.

—Emulsification or Dispersion—

In another vessel in which a stirrer and a thermometer were set, the following was added: 230 parts of [Aqueous phase 1] that was heated to 50° C. Meanwhile, the following were well mixed in advance: 99 parts of [Oil phase 1] that was kept at 50° C., and 25 parts of [Crystalline resin precursor B1]. The mixture was added to the above [Aqueous phase 1]. Then, the substances were stirred by a TK homomixer (manufactured by Tokushu Kika Kogyo Co., Ltd.) at 40° C. to 50° C. at 13,000 rpm for one minute. As a result, [Emulsion slurry 1] was obtained.

In a vessel in which a stirrer and a thermometer were set, [Emulsion slurry 1] was put. At 50° C., the solvent was removed over eight hours. After that, the aging took place for five hours at 45° C., and [Dispersion slurry 1] was obtained.

After 100 parts of [Dispersion slurry 1] of base particles of toner obtained were filtered under reduced pressure, the following cleaning process was carried out:

(1) 100 parts of ion-exchanged water were added to the filter cake, which was then filtered after being mixed by a TK homomixer (6,000 rpm, five minutes).

(2) 100 parts of a 10% sodium hydroxide aqueous solution were added to the filter cake of the above section (1), which was then filtered under reduced pressure after being mixed by a TK homomixer (6,000 rpm, ten minutes).

(3) 100 parts of a 10% hydrochloric acid were added to the filter cake of the above section (2), which was then filtered after being mixed by a TK homomixer (6,000 rpm, five minutes).

(4) 300 parts of ion-exchanged water were added to the filter cake of the above section (3), and an operation of mixing with the use of a TK homomixer (6,000 rpm, five minutes) and then filtering was carried out two times. As a result, [Filter cake 1] was obtained.

The obtained [Filter cake 1] was dried by a circulation drier at 45° C. for 48 hours. After that, the substance was sieved with a 75 μm-opening mesh, and [Toner base particles 1] were created.

Then, 100 parts of the obtained [Toner base particles 1], and 1.0 part of hydrophobic silica (HDK-2000, Manufactured by Wacker Chemie) were mixed by HENSCHEL MIXER. As a result, the following was produced: [Toner 1], Volume average particle diameter: 5.6 μm.

<Production of Carrier>

The carrier that was used for the two-component developer of the present example was produced in the following manner.

As for the core material, 5,000 parts of Mn ferrite particles (Weight-average particle diameter: 35 μm) were used. As for the covering material, a coat liquid was used. The coat liquid was prepared by dispersing the following substances for ten minutes with the use of a stirrer: 450 parts of toluene, 450 parts of silicone resin SR2400 (manufactured by Dow Corning Toray Silicone Co., Ltd., Nonvolatile content: 50%), 10 parts of aminosilane SH6020 (manufactured by Dow Corning Toray Silicone Co., Ltd.), and 10 parts of carbon black. In a coating device in which a rotation-type bottom plate disk and a stirring blade were provided in a fluidized bed to form a swirling flow for coating, the core material and the coat liquid were put. The coat liquid was applied to the core material. The coated product obtained was baked in an electric furnace at 250° C. for two hours. As a result, [Carrier A] was obtained.

<Production of Two-Component Developer>

Relative to 100 parts of [Carrier A], 7 parts of the toner produced by the above process were evenly mixed by a Turbula mixer (manufactured by Willy A. Bachofen (WAB)) for three minutes at 48 rpm, and were charged: the Turbula mixer was of a type in which a vessel rotates for stirring. In the present example, 200 g of the carrier A and 14 g of the toner were put into a stainless steel container with an internal volume of 500 mL, and were mixed.

The two-component developer produced by the above process was put into a developing unit of a tandem-type image forming apparatus (which is an image forming apparatus A shown in FIG. 3) of an indirect transfer type that employed a contact charging method, a two-component developing method, a secondary transfer method, a blade cleaning method, and an external-heating roller fixing method. Then, an image was formed, and the performance of the toner and developer was evaluated.

Figure 3:
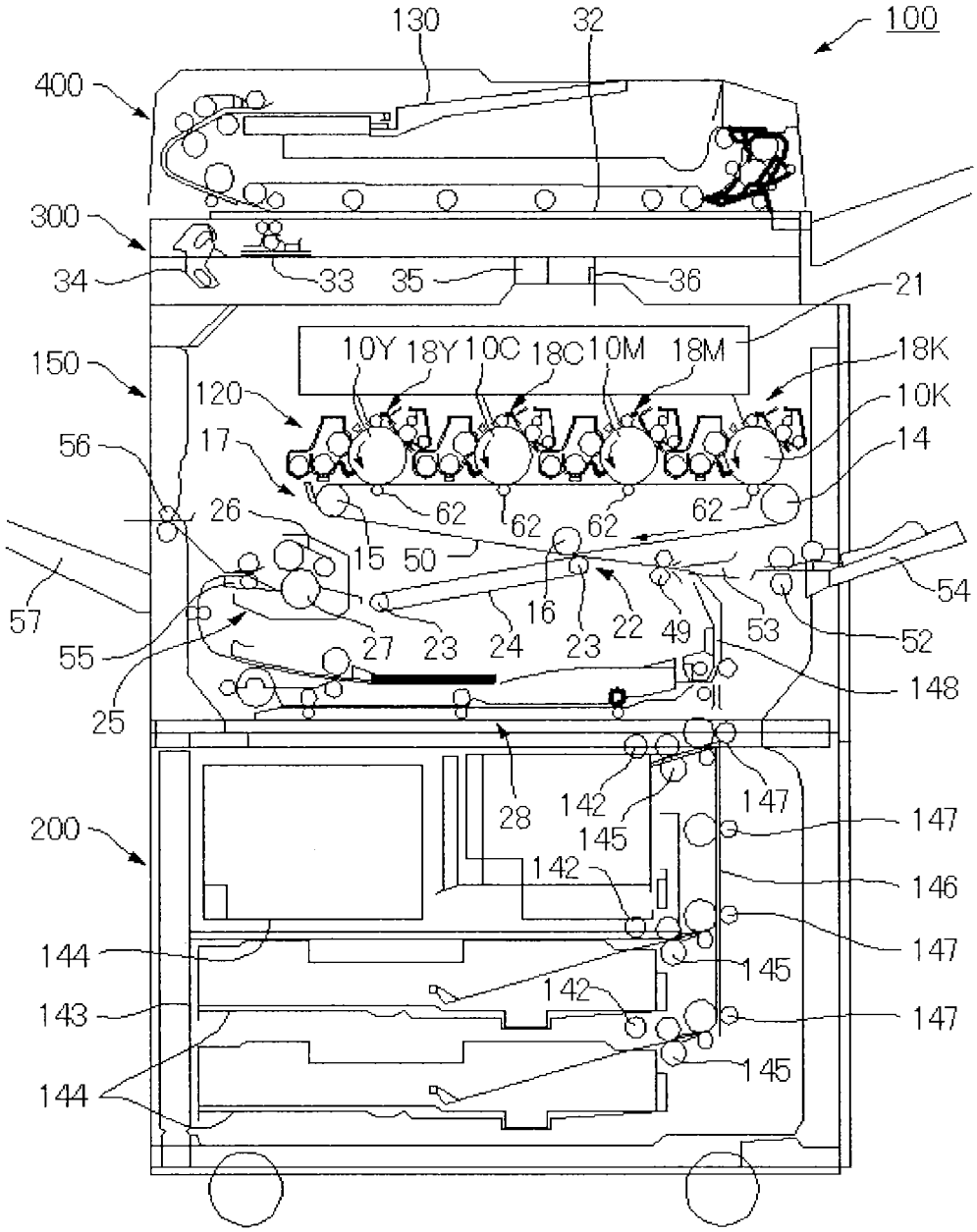
FIG. 3 is a schematic diagram showing one example of a tandem-type image forming apparatus of the present invention.
Figure 4:
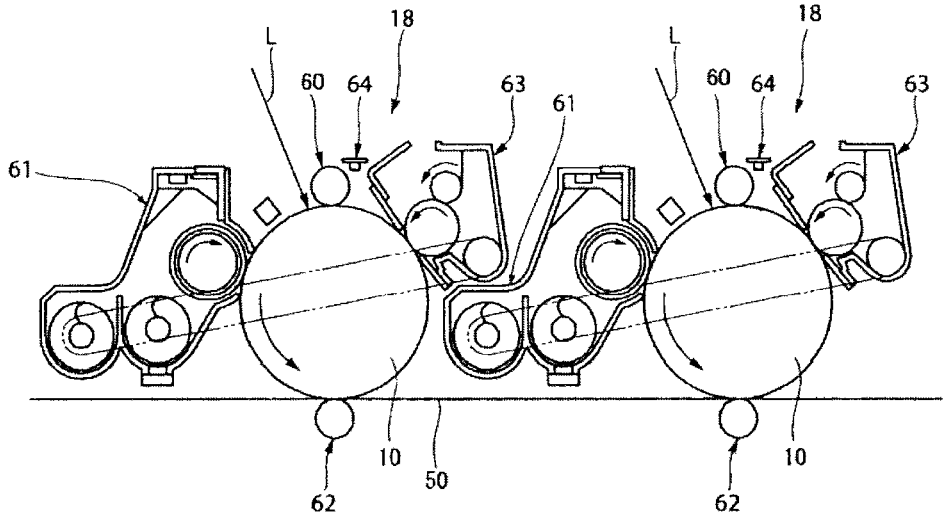
FIG. 4 is an enlarged view of each of image formation elements shown in FIG. 3.

The following describes in detail the image forming apparatus A, which was used for performance evaluation of the present invention, with reference to FIGS. 3 and 4.

—Image Forming Apparatus A—

FIG. 3 is a schematic diagram showing one example of a tandem-type image forming apparatus. FIG. 4 is an enlarged view of each of image formation elements shown in FIG. 3.

The image forming apparatus A 100 shown in FIG. 3 is a tandem-type color image forming apparatus. The image forming apparatus A 100 includes a copying device body 150, a paper feed table 200, a scanner 300, and an automatic document feeder (ADF) 400.

In a central portion of the copying device body 150, an intermediate transfer member 50 of an endless belt type is provided. The intermediate transfer member 50 is stretched over support rollers 14, 15, and 16. In FIG. 3, the intermediate transfer member 50 can rotate clockwise. In the vicinity of the support roller 15, an intermediate transfer member cleaning unit 17 is provided to remove residual toner on the intermediate transfer member 50. Along a transport direction of the intermediate transfer member 50 that is stretched over the support rollers 14 and 15, a tandem-type developing unit 120 is disposed: In the tandem-type developing unit 120, four image formation units 18Y, 18C, 18M and 18K of yellow, cyan, magenta, and black are so arranged as to face the intermediate transfer member 50. In the vicinity of the tandem-type developing unit 120, an exposing unit 21 is disposed. On the other side of the intermediate transfer member 50 from the tandem-type developing unit 120, a secondary transfer unit 22 is disposed. In the secondary transfer unit 22, an endless-type secondary transfer belt 24 is stretched over a pair of rollers 23. A recording medium, which is conveyed on the secondary transfer belt 24, and the intermediate transfer member 50 can come in contact with each other. In the vicinity of the secondary transfer unit 22, a fixing unit 25 is disposed.

Incidentally, in the image forming apparatus A 100, in the vicinity of the secondary transfer unit 22 and the fixing unit 25, a flipping device 28 is placed to flip the recording medium, thereby enabling images to be formed on both sides of the recording medium.

The following describes formation of a full-color image by the tandem-type developing unit 120.

That is, first, on a document table 130 of the automatic document feeder (ADF) 400, a document is set. Alternatively, the automatic document feeder 400 is opened, and a document is set on a contact glass 32 of the scanner 300. Then, the automatic document feeder 400 is closed. After a start switch (not shown) is pressed, in the case where a document is set in the automatic document feeder 400, the document is conveyed and moved onto the contact glass 32 before the scanner 300 starts to operate. In the case where the document is set on the contact glass 32, the scanner 300 immediately starts to operate. Then, a first running body 33 and a second running body 34 run. At this time, because of the first running body 33, the light from a light source is emitted. Moreover, the light reflected from the surface of the document is reflected by a mirror of the second running body 34. Via an imaging lens 35, the light is received by a reading sensor 36. In this manner, the color document (color image) is read, and image information of black, yellow, magenta and cyan is recognized. Each piece of image information of black, yellow, magenta or cyan is transmitted to each image formation unit 18 (black image formation unit 18K, yellow image formation unit 18Y, magenta image formation unit 18M, and cyan image formation unit 18C) in the tandem-type developing unit 120. Each image formation unit forms each toner image of black, yellow, magenta or cyan. That is, each image formation unit 18 (black image formation unit 18K, yellow image formation unit 18Y, magenta image formation unit 18M, and cyan image formation unit 18C) in the tandem-type developing unit 120 includes, as shown in FIG. 4, the following components: an electrostatic latent image bearing member 10 (black electrostatic latent image bearing member 10K, yellow electrostatic latent image bearing member 10Y, magenta electrostatic latent image bearing member 10M, or cyan electrostatic latent image bearing member 10C); a charging unit 60, which is designed to evenly charge the electrostatic latent image bearing member; an exposing unit, which is designed to expose the electrostatic latent image bearing member in a corresponding image pattern of each color image on the basis of each piece of color image information (In FIG. 4, L) to form an electrostatic latent image corresponding to each color image on the electrostatic latent image bearing member; a developing unit 61, which is designed to develop the electrostatic latent image with each color toner (black toner, yellow toner, magenta toner, or cyan toner) to form a toner image of each color toner; a transfer charging unit 62, which is used to transfer the toner image to the intermediate transfer member 50; a cleaning unit 63; and a discharging unit 64. On the basis of the image information of each color, an image of each single color (black image, yellow image, magenta image, or cyan image) can be formed. As for the formed black image, yellow image, magenta image, or cyan image, onto the intermediate transfer member 50 that is rotated and moved by the support rollers 14, 15, and 16, the following images are sequentially transferred (Primary transfer): the black image formed on the black electrostatic latent image bearing member 10K, the yellow image formed on the yellow electrostatic latent image bearing member 10Y, the magenta image formed on the magenta electrostatic latent image bearing member 10M, and the cyan image formed on the cyan electrostatic latent image bearing member 10C. Then, the black image, the yellow image, the magenta image, and the cyan image are superimposed on the intermediate transfer member 50. As a result, a composite color image (color transfer image) is formed.

Meanwhile, on the paper feed table 200, one of paper feed rollers 142 is selectively rotated, and a recording medium is sent out from one of multiple-stage paper cassettes 144 provided in a paper bank 143. One piece of recording media is separated by a separation roller 145 before being sent to a paper feed path 146. The recording medium is then conveyed by a conveying roller 147 into a paper feed path 148 in the copying device body 150, and is stopped as the recording medium hits a registration roller 49. Alternatively, as the paper feed rollers 142 are rotated, a recording medium is sent out from a manual bypass tray 54. One piece of recording media is separated by a separation roller 52 before being input into a manual paper feed path 53. The recording medium is similarly stopped as the recording medium hits the registration roller 49. The registration roller 49 is typically grounded for use. However, in order to remove paper dust of the recording media, bias may be applied thereto when the registration roller 49 is used. At a timing when a composite color image (color transfer image) is synthesized on the intermediate transfer member 50, the registration roller 49 is rotated. A recording medium is supplied into between the intermediate transfer member 50 and the secondary transfer unit 22. The composite color image (color transfer image) is transferred by the secondary transfer unit 22 onto the recording medium (Secondary transfer). In this manner, the color image is transferred onto the recording medium, and is formed. Incidentally, after the image is transferred, the residual toner on the intermediate transfer member 50 is wiped out by the intermediate transfer member cleaning unit 17.

The recording medium on which the color image is transferred and formed is conveyed by the secondary transfer unit 22, and is sent to the fixing unit 25. In the fixing unit 25, the composite color image (color transfer image) is fixed onto the recording medium by heat and pressure. After that, the recording medium is switched by a switching claw 55, and is ejected by an ejection roller 56. The recording medium is stacked on an ejection tray 57. Alternatively, the recording medium is switched by the switching claw 55, and is flipped by the flipping device 28 so that the recording medium returns to the transfer position, where an image is also recorded on the back side thereof. After that, the recording medium is ejected by the ejection roller 56, and is stacked on the ejection tray 57. Incidentally, reference numerals 26 and 27 in FIG. 3 represent a fixing belt and a pressure roller, respectively.

One of the problems to be solved by the present invention is the occurrence of image-transport scratches that occur during the recrystallization immediately after heat fixing. In the image forming apparatus A 100, the above problem occurs at a time when the recording medium goes through the ejection roller 56, or a conveying roller that is disposed in the flipping device 28.

<Evaluation>

The following describes in detail how to evaluate the performance of the toner and developer according to the present invention.

<<Low-Temperature Fixation Performance (Fixation Lower Limit Temperature)>>

The image forming apparatus A was used. On a transfer paper (manufactured by Ricoh Business Expert Co., Ltd., Copying printing paper <70>), a solid image (Image size: 3 cm×8 cm) was created; the amount of toner that had adhered thereto after the transfer was 0.85±0.1 mg/cm$^2$. The fixation took place with varying temperatures of the fixing belt. On the surface of the obtained fixed image, an image was drawn by drawing tester AD-401 (manufactured by Ueshima Seisakusho Co., Ltd.) with the use of a ruby needle (Tip radius: 260 μmR to 320 μmR, Tip angle: 60°) and a load of 50 g. The surface of the drawn image was strongly rubbed with fabric (HANICOT #440, manufactured by Haniron K.K.) five times. A fixing-belt temperature at which scraping of the image was almost nonexistent was regarded as a fixation lower limit temperature. On the transfer paper, the solid image was created at a position 3.0 cm away from a paper-feed-direction tip. Incidentally, the speed of the fixing device passing through a nip portion was 280 mm/s. The lower the fixation lower limit temperature becomes, the better the low-temperature fixation performance is. Table 3 shows the results.

<<Hot-Offset Resistance (Fixable Temperature Range)>>

The image forming apparatus A was used. On a transfer paper (manufactured by Ricoh Co., Ltd., Type 6200), a solid image (Image size: 3 cm×8 cm) was created; the amount of toner that had adhered thereto after the transfer was 0.85±0.1 mg/cm$^2$. The fixation took place with varying temperatures of the fixing belt. The presence of a hot offset was visually checked. A temperature range between an upper limit temperature at which no hot offset occurred, and the fixation lower limit temperature was regarded as a fixable temperature range. On the transfer paper, the solid image was created at a position 3.0 cm away from a paper-feed-direction tip. Incidentally, the speed of the fixing device passing through a nip portion was 280 mm/s. The wider the fixable temperature range becomes, the better the hot offset resistance is. The average temperature range of a conventional full-color toner is about 50° C. Table 3 shows the results.

<<Image-Transport Scratches>>

The image forming apparatus A was used. On a transfer paper (manufactured by Ricoh Co., Ltd., Type 6200), a solid image was created across the paper; the amount of toner that had adhered thereto after the transfer was 0.85±0.1 mg/cm$^2$. The fixation took place after the temperature of the fixing belt was set to: the toner's fixation lower limit temperature+10° C. The degree of image-transport scratches, which were caused by an ejection roller (ejection roller 56 in FIG. 3) on the surface of the obtained fixed image, was evaluated by comparing with rank samples. Incidentally, the speed of the fixing device passing through a nip portion was 280 mm/s. Paper was fed in a horizontal direction of an A4 format. Table 3 shows the results.

The rank samples range from those with many image-transport scratches to those with little image-transport scratches, on a scale of 0 to 5.0 in increments of 0.5: The higher the score, the less the image-transport scratches. Incidentally, the score "5.0" is a level at which no image-transport scratches can be visually confirmed. The score "3.0" is a level at which a few image-transport scratches can be visually confirmed. The score "3.0", or higher score, is an acceptable level. The score "2.5", or lower score, is an unacceptable level. The score "1.0" is a level at which obvious image-transport scratches can be visually confirmed; part of the image has been scraped, and the underlying transfer paper can be seen.

<<Heat-Resistant Storage Stability>>

A 50 mL glass container was filled with the toner, and was left for 24 hours in a 50° C. thermostatic bath. Then, the container was cooled down to 24° C. In accordance with the needle penetration test (JIS K2235-1991), needle penetration (mm) was measured. The heat-resistant storage stability was assessed based on the following criteria: the greater the needle penetration, the better the heat-resistant storage stability. If the degree of the needle penetration is less than 10 mm, troubles are likely to occur when in use. Table 3 shows the results.

[Evaluation Criteria]

A: 25 mm or more in needle penetration

B: 20 mm or more, but less than 25 mm in needle penetration

C: 15 mm or more, but less than 20 mm in needle penetration

D: 10 mm or more, but less than 15 mm in needle penetration

E: Less than 10 mm in needle penetration

Example 2

Production of Toner 2

[Toner 2] was produced in a similar way to that in Example 1 except that [Crystalline resin A1] in Example 1 was replaced with [Crystalline resin A2].

The obtained toner was evaluated in a similar way to that in Example 1.

Example 3

Production of Toner 3

[Toner 3] was produced in a similar way to that in Example 1 except that [Crystalline resin A1] in Example 1 was replaced with [Crystalline resin A3].

The obtained toner was evaluated in a similar way to that in Example 1.

Example 4

Production of Toner 4

[Toner 4] was produced in a similar way to that in Example 1 except that [Crystalline resin A1] in Example 1 was replaced with [Crystalline resin A4].

The obtained toner was evaluated in a similar way to that in Example 1.

Example 5

Production of Toner 5

[Toner 5] was produced in a similar way to that in Example 1 except that [Crystalline resin A1] in Example 1 was replaced with [Crystalline resin A5].

The obtained toner was evaluated in a similar way to that in Example 1.

Example 6

Production of Toner 6

[Toner 6] was produced in a similar way to that in Example 1 except that [Crystalline resin A1] in Example 1 was replaced with [Crystalline resin A6].

The obtained toner was evaluated in a similar way to that in Example 1.

Example 7

Production of Toner 7

[Toner 7] was produced in a similar way to that in Example 1 except that [Crystalline resin A1] in Example 1 was replaced with [Crystalline resin A7].

The obtained toner was evaluated in a similar way to that in Example 1.

Example 8

Production of Toner 8

[Toner 8] was produced in a similar way to that in Example 2 except that 25 parts of [Crystalline resin precursor B1] in [Emulsification or dispersion] of Example 2 were replaced with 15 parts of [Crystalline resin precursor B1].

The obtained toner was evaluated in a similar way to that in Example 1.

Example 9

Production of Toner 9

[Toner 9] was produced in a similar way to that in Example 2 except that organically-modified layered inorganic mineral CLAYTONE APA of [Organically-modified layered inorganic mineral masterbatch F1] in Example 2 was replaced with CLAYTONE HY (montmorillonite compound that was modified with quaternary ammonium salts at least partially having polyoxyethylene groups; manufactured by Southern Clay Products).

The obtained toner was evaluated in a similar way to that in Example 1.

Example 10

Production of Toner 10

[Toner 10] was produced in a similar way to that in Example 2 except that 2 parts of [Organically-modified layered inorganic mineral masterbatch F1] in [Preparation of oil phase] of Example 2 were replaced with 5 parts of [Organically-modified layered inorganic mineral masterbatch F1].

The obtained toner was evaluated in a similar way to that in Example 1.

Example 11

Production of Toner 11

[Toner 11] was produced in a similar way to that in Example 2 except that 2 parts of [Organically-modified layered inorganic mineral masterbatch F1] in [Preparation of oil phase] of Example 2 were replaced with 1 part of [Organically-modified layered inorganic mineral masterbatch F1].

The obtained toner was evaluated in a similar way to that in Example 1.

Comparative Example 1

Production of Toner a

[Toner a] was produced in a similar way to that in Example 1 except that [Crystalline resin A1] in Example 1 was replaced with [Crystalline resin A8].

The obtained toner was evaluated in a similar way to that in Example 1.

Comparative Example 2

Production of Toner b

[Toner b] was produced in a similar way to that in Example 2 except that 2 parts of [Organically-modified layered inorganic mineral masterbatch F1] in [Preparation of oil phase] of Example 2 were replaced with 0 parts.

The obtained toner was evaluated in a similar way to that in Example 1.

Comparative Example 3

Production of Toner c

[Toner c] was produced in a similar way to that in Example 2 except that organically-modified layered inorganic mineral CLAYTONE APA of [Organically-modified layered inorganic mineral masterbatch F1] in Example 2 was replaced with an unmodified montmorillonite compound, which was an unmodified layered inorganic mineral, (Kunipia, manufactured by Kunimine Industries Co., Ltd.)

The obtained toner was evaluated in a similar way to that in Example 1.

Comparative Example 4

Production of Toner d

[Toner d] was produced in a similar way to that in Example 1 except that [Crystalline resin A1] in Example 1 was replaced with [Crystalline resin A9].

The obtained toner was evaluated in a similar way to that in Example 1.

Table 2 below shows the composition of the obtained toner.

TABLE 2

| | Toner | Organically-modified layered inorganic mineral Type | Binder resin: Crystalline resin A Type | Binder resin: Crystalline resin B Type | Binder resin: Amorphous resin C Type |
|---|---|---|---|---|---|
| Example 1 | 1 | CLAYTONE APA | A1 | B + B1 | C1 |
| Example 2 | 2 | CLAYTONE APA | A2 | B + B1 | C1 |
| Example 3 | 3 | CLAYTONE APA | A3 | B + B1 | C1 |
| Example 4 | 4 | CLAYTONE APA | A4 | B + B1 | C1 |
| Example 5 | 5 | CLAYTONE APA | A5 | B + B1 | C1 |
| Example 6 | 6 | CLAYTONE APA | A6 | B + B1 | C1 |
| Example 7 | 7 | CLAYTONE APA | A7 | B + B1 | C1 |
| Example 8 | 8 | CLAYTONE APA | A2 | B + B1 | C1 |
| Example 9 | 9 | CLAYTONE HY | A2 | B + B1 | C1 |
| Example 10 | 10 | CLAYTONE APA | A2 | B + B1 | C1 |

TABLE 2-continued

| | Toner | Organically-modified layered inorganic mineral Type | Binder resin Crystalline resin A Type | Crystalline resin B Type | Amorphous resin C Type |
|---|---|---|---|---|---|
| Example 11 | 11 | CLAYTONE APA | A2 | B + B1 | C1 |
| Comp Ex. 1 | a | CLAYTONE APA | A8 | B + B1 | C1 |
| Comp Ex. 2 | b | — | A2 | B + B1 | C1 |
| Comp Ex. 3 | c | Kunipia (unmodified montmorillonite) | A2 | B + B1 | C1 |
| Comp Ex. 4 | d | CLAYTONE APA | A9 | B + B1 | C1 |

Table 3 shows the evaluation results.

TABLE 3

| | Toner | Fixation lower limit temp. (° C.) | Fixable temperature range (° C.) | Image-transport scratches | Heat-resistant storage stability |
|---|---|---|---|---|---|
| Example 1 | 1 | 110 | 80 | 3.0 | B |
| Example 2 | 2 | 105 | 70 | 3.0 | B |
| Example 3 | 3 | 115 | 70 | 3.0 | B |
| Example 4 | 4 | 110 | 75 | 3.0 | B |
| Example 5 | 5 | 110 | 75 | 3.0 | B |
| Example 6 | 6 | 105 | 60 | 3.0 | B |
| Example 7 | 7 | 105 | 60 | 3.0 | B |
| Example 8 | 8 | 105 | 65 | 3.0 | B |
| Example 9 | 9 | 105 | 65 | 3.0 | B |
| Example 10 | 10 | 110 | 75 | 4.0 or more | B |
| Example 11 | 11 | 100 | 65 | 3.0 | B |
| Comp Ex. 1 | a | 110 | 70 | 2.5 | B |
| Comp Ex. 2 | b | 105 | 70 | 1.0 | B |
| Comp Ex. 3 | c | — | — | — | — |
| Comp Ex. 4 | d | 100 | 50 | 2.5 | D |

Aspects of the present invention are, for example, as follows.

<1> An electrophotographic toner, including:

a binder resin;

a colorant; and an organically-modified layered inorganic mineral, wherein the binder resin contains 50% by mass or more of a crystalline resin relative to the binder resin, and the crystalline resin contains a resin having a sulfonic acid group, and wherein an amount of the sulfonic acid group is 0.1% by mass to 2.0% by mass relative to the resin having the sulfonic acid group.

<2> The electrophotographic toner according to <1>, wherein the organically-modified layered inorganic mineral is a layered inorganic mineral in which at least some of ions between layers of the layered inorganic mineral are modified with organic ions.

<3> The electrophotographic toner according to <2>, wherein the layered inorganic mineral is smectite-group clay mineral.

<4> The electrophotographic toner according to <2> or <3>, wherein the organic ions are organic cations.

<5> The electrophotographic toner according to any one of <1> to <4>, wherein the crystalline resin contains a urethane skeleton, a urea skeleton, or both thereof.

<6> The electrophotographic toner according to any one of <1> to <5>, wherein an amount of the organically-modified layered inorganic mineral is 0.1% by mass to 3.0% by mass.

<7> The electrophotographic toner according to any one of <1> to <6>, wherein the electrophotographic toner is obtained by dispersing or emulsifying fine particles in an aqueous medium and granulating toner particles, the fine particles containing the binder resin, the colorant and the organically-modified layered inorganic mineral.

<8> A developer, including:

the electrophotographic toner according to any one of <1> to <7>.

<9> An image forming apparatus, including:

an electrostatic latent image bearing member;

a charging unit configured to charge a surface of the electrostatic latent image bearing member;

an exposing unit configured to expose the charged surface of the electrostatic latent image bearing member to light to form an electrostatic latent image;

a developing unit configured to develop the electrostatic latent image with a toner to form a visible image;

a transfer unit configured to transfer the visible image to a recording medium; and a fixing unit configured to fix the transferred visible image on the recording medium, wherein the toner is the electrophotographic toner according to any one <1> to <7>.

This application claims priority to Japanese application No. 2012-63847, filed on Mar. 21, 2012 and incorporated herein by reference.

What is claimed is:

1. An electrophotographic toner, comprising:

a binder resin;

a colorant; and an organically-modified layered inorganic mineral, wherein the binder resin comprises 50% by mass or more of a crystalline resin relative to the binder resin, the crystalline resin comprises: a skeleton, which is a urethane skeleton, a urea skeleton, or both; and a resin having a sulfonic acid group, and an amount of the sulfonic acid group is 0.1% by mass to 2.0% by mass relative to the resin having the sulfonic acid group.

2. The electrophotographic toner according to claim 1, wherein the organically-modified layered inorganic mineral is a layered inorganic mineral in which at least some of ions between layers of the layered inorganic mineral are modified with organic ions.

3. The electrophotographic toner according to claim 2, wherein the layered inorganic mineral is smectite-group clay mineral.

4. The electrophotographic toner according to claim 2, wherein the organic ions are organic cations.

5. The electrophotographic toner according to claim 1, wherein an amount of the organically-modified layered inorganic mineral is 0.1% by mass to 3.0% by mass.

6. The electrophotographic toner according to claim 1, wherein the electrophotographic toner is obtained by a process comprising:

dispersing or emulsifying fine particles comprising the binder resin, the colorant and the organically-modified layered inorganic mineral in an aqueous medium, and granulating toner particles.

7. A developer, comprising: an electrophotographic toner, wherein the electrophotographic toner comprises: a binder resin; a colorant; and an organically-modified layered inorganic mineral, the binder resin comprises 50% by mass or more of a crystalline resin relative to the binder resin, the crystalline resin comprises: a skeleton, which is a urethane skeleton, a urea skeleton, or both; and a resin having a sulfonic acid group, and an amount of the sulfonic acid group is 0.1% by mass to 2.0% by mass relative to the resin having the sulfonic acid group.

8. The electrophotographic toner according to claim 1, wherein the binder resin comprises 65% by mass or more of the crystalline resin relative to the binder resin.

9. The electrophotographic toner according to claim 1, wherein the organically-modified layered inorganic mineral is finely and evenly dispersed in the vicinity of a surface layer of the toner.

* * * * *